US006831230B2

(12) United States Patent
Ide et al.

(10) Patent No.: US 6,831,230 B2
(45) Date of Patent: Dec. 14, 2004

(54) SHIELD PROCESSING STRUCTURE FOR FLAT SHIELDED CABLE AND METHOD OF SHIELD PROCESSING THEREOF

(75) Inventors: Tetsuro Ide, Haibara-gun (JP); Akira Mita, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/457,448

(22) Filed: Jun. 10, 2003

(65) Prior Publication Data

US 2003/0213610 A1 Nov. 20, 2003

Related U.S. Application Data

(63) Continuation-in-part of application No. 10/301,721, filed on Nov. 22, 2002, now abandoned.

(30) Foreign Application Priority Data

Nov. 28, 2001 (JP) ..... P2001-363311
Jun. 10, 2002 (JP) ..... P2002-168585
Jun. 10, 2002 (JP) ..... P2002-168589

(51) Int. Cl.[7] ..... H01R 4/00
(52) U.S. Cl. ..... 174/84 R
(58) Field of Search ..... 174/84 R, 87, 174/36, 94 R, 72 C

(56) References Cited

U.S. PATENT DOCUMENTS 5,003,126 A * 3/1991 Fujii et al. ..... 174/36
5,569,050 A * 10/1996 Lloyd ..... 439/465
5,584,122 A * 12/1996 Kato et al. ..... 29/872
5,869,784 A * 2/1999 Shinchi ..... 174/84 R
5,922,993 A * 7/1999 Ide et al. ..... 174/84 R
5,925,202 A * 7/1999 Ide et al. ..... 156/73.2
5,959,252 A * 9/1999 Ide et al. ..... 174/84 R
2002/0062979 A1 5/2002 Murakami et al.
2003/0102145 A1 * 6/2003 Ide et al. ..... 174/87

FOREIGN PATENT DOCUMENTS

JP 7-37437 2/1995
JP 2000-21249 1/2000
JP 2002-324436 11/2002

* cited by examiner

*Primary Examiner*—William H. Mayo, III
(74) *Attorney, Agent, or Firm*—Sughrue Mion, PLLC

(57) ABSTRACT

The shield processing structure for a flat shielded cable includes: a flat shielded cable including two shielded cores, a drain wire, an aluminum foil shield member for covering the two shielded cores and the drain wire, and an insulating outer jacket for covering the aluminum foil shield member; and resin members for clamping the flat shielded cable with joining surfaces. The flat shielded cable is clamped between the pair of resin members, and a grounding wire is interposed between the flat shielded cable and the resin member. In this state, ultrasonic vibration are applied across the pair of resin members, whereby at least insulating outer jackets are melted and scattered, and a conductor of the grounding wire, on the one hand, and the grounding wire-use contact portion of aluminum foil shield member and the drain wire are brought into contact with each other.

14 Claims, 31 Drawing Sheets

SHIELD PROCESSING STRUCTURE FOR FLAT SHIELDED CABLE AND METHOD OF SHIELD PROCESSING THEREOF

This is a Continuation-In-Part of application Ser. No. 10/301,721 filed Nov. 22, 2002; now abandoned, the disclosure of which is incorporated herein by reference.

BACKGROUND OF THE INVENTION

The present invention relates to a shield processing structure for a flat shielded cable for connecting a shield cover member of a flat shielded cable and a grounding wire, as well as a method of shield processing thereof.

As shown in FIG. 26, a flat shielded cable 100 is comprised of two shielded cores 103 in which cores 101 are respectively covered with insulating inner jackets 102 and which are arranged in parallel; a conductive shield cover member 104 which covers the outer peripheries of the two shielded cores 103 and has a grounding wire-use contact portion 104*a* provided on the outer side in the direction in which the two shielded cores 103 are juxtaposed; a drain wire 105 disposed inside the grounding wire-use contact portion 104*a*; and an insulating outer jacket 106 for further covering the outer periphery of the shield cover member 104. As a conventional shield processing structure for the flat shielded cable 100 thus constructed, one disclosed in JP-A-2000-21249 shown in FIG. 27 is known.

In the shield processing structure in FIG. 27, the insulating outer jacket 106 in the vicinity of the end portion of the flat shielded cable 100 and the shield cover member 104 excluding the portion of the grounding wire-use contact portion 104*a* are peeled off to thereby expose the two shielded cores 103. Further, insulation displacement terminals 110*a* are respectively subjected to insulation displacement connection to the two shielded cores 103 so as to effect terminal processing of signal conductors, and an insulation displacement terminal 110*b*, to which a grounding wire is connected, is subjected to insulation displacement connection to the drain wire 105 and the shield cover member 104 so as to effect shield processing.

However, with the above-described conventional shield processing structure, it is necessary to effect the operation of removing the jacket of the terminal of the flat shielded cable 100, and the jacket removal involves only the portions of the two shielded cores 103, and the jacket removal is not effected with respect to the portion of the grounding wire-use contact portion 104*a* of the shield cover member 104. Hence, there are problems in that the jacket removal is very troublesome and that it requires a technique of high precision.

SUMMARY OF THE INVENTION

Accordingly, the invention has been devised to overcome the above-described problems, and its object is to provide a shield processing structure for a flat shielded cable which makes it unnecessary to effect the jacket removal operation itself and makes it possible to effect shield processing easily in a simple process, as well as a method of shield processing thereof.

In order to solve the aforesaid object, the invention is characterized by having the following arrangement. Aspect 1 A structure for processing a flat shielded cable comprising:

A first aspect of the invention is a structure for processing a flat shielded cable, the includes the flat shielded cable, with a plurality of shielded cores, each including a core covered with an insulating inner jacket, a conductive shield cover member which covers outer peripheries of the plurality of shielded cores and has a grounding wire-use contact portion, and an insulating outer jacket for covering an outer periphery of the shielded cover member. The structure also includes a ground wire; a pair of resin members including joining surfaces and recesses,respectively, wherein the joining surface of the resin members are abutted against each other, the recesses form a hole substantially corresponding to an outer shape of a part of the flat shielded cable; and an ultrasonic generator for generating ultrasonic vibration. The ultrasonic vibration generated by the ultrasonic generator is applied to at least one of the pair of resin members which clamps and compress at least a part of the flat shielded cable in a state that the ground wire is interposed between the flat shielded cable and one of the resin members, so that at least the insulating outer jacket is melted and scattered and a contact portion connecting a conductor of the grounding wire and the grounding wire-use contact portion is formed.

According to a second aspect of the invention, the plurality of shielded cores are arranged side by side.

According to a third aspect of the invention, the hole formed by the recesses substantially corresponds to an outer shape of the shielded cores.

According to a fourth aspect of the invention, the pair of resin members clamp the flat shielded cable, the of resin members do not contact a portion of the flat shielded cable located on an outer side of the grounding wire-use contact portion.

According to the fifth aspect of the invention, a drain wire is disposed inside the grounding wire-use contact portion.

According to the sixth aspect of the invention, in the respective joining surfaces of the pair of resin members, portions where both the grounding ire-use contact portion and the grounding wire are disposed are formed as flat surfaces for pressing the ground wire-use contact portion and the grounding wire with the respective joining surface abutting against each other.

According to a seventh aspect of the invention, inner peripheral surfaces of the recesses of the pair of resin members are formed as tapered surfaces such that the diameter of each of the inner peripheral surfaces on an exit side of the flat shielded cable is gradually enlarged from an inner side toward an outer side.

According to the eighth aspect of the invention, in the respective joining surfaces of the pair of resin members on an exit side of the grounding wire, grounding wire-accommodating grooves are respectively provided so that a hole whose diameter is larger than a diameter of the grounding wire is formed with the joining surfaces abutting against each other, and inner peripheral surfaces of the grounding wire-accommodating grooves are formed as tapered surfaces such that the diameter of each the inner peripheral surfaces on an exit side of the grounding wire is gradually enlarged from an inner side toward an outer side.

According to a ninth aspect of the invention, the structure also includes a positional-offset preventing projection formed on one of the pair of resin members; and a positional-offset preventing groove formed on another of the pair of resin members; wherein the positional-offset preventing projection and positional-offset preventing groove are formed at portions of the joining surfaces of the pair of resin members with which the flat shielded cable does not contact in a state when the flat shielded cable is clamped; wherein a position of the positional-offset preventing projection corresponds to an opposing position of the positional-offset preventing groove; and wherein the positional-offset preventing projection engages the positional-offset preventing groove in a state when the flat shielded cable is clamped by the pair of resin members.

According to a tenth aspect of the invention, the ground wire is arranged substantially parallel to the shielded cores such that one end portion of the ground wire is interposed between the adjacent shielded cores.

According to an eleventh aspect of the invention, the shielding covering member has a two-layer structure, and comprises an electrically-insulative foil-reinforcing sheet as an inner layer, and an electrically-conductive metal foil as an outer layer.

According to a twelfth aspect of the invention, the foil-reinforcing sheet is a polyester sheet.

The thirteenth aspect of the invention, is a method of processing a flat shielded cable which includes a plurality of shielded cores, each including a core covered with an insulating inner jacket, a conductive shield cover member which covers outer peripheries of the plurality of shielded cores and has a grounding wire-use contact portion, and an insulating outer jacket for covering an outer periphery of the shielded cover member, and a ground wire by a pair of resin members. The method includes the steps of: clamping the flat shielded cable between the pair of resin members; interposing the ground wire between the flat shielded cable and the resin member; and applying ultrasonic vibration across the pair of resin members so that at least the insulating outer jacket is melted and scattered, and a conductor of the grounding wire and the grounding wire-use contact portion are electrically brought into contact with each other.

According to a fourteenth aspect of the invention, in the clamping step, the pair of resin members compress shielded cable.

According to a fifteenth aspect of the invention, the pair of resin members clamp the flat shielded cable, the pair of resin members do not come into contact with a portion located on an outer side of each of the shielded cores but come into contact with a portion located on an outer side of the grounding wire-use contact portion.

DETAILED DESCRIPTION OF PREFERRED EMBODIMENTS

Hereafter, a description will be given of the embodiments of the invention with reference to the drawings.

First Embodiment

Figure 1:
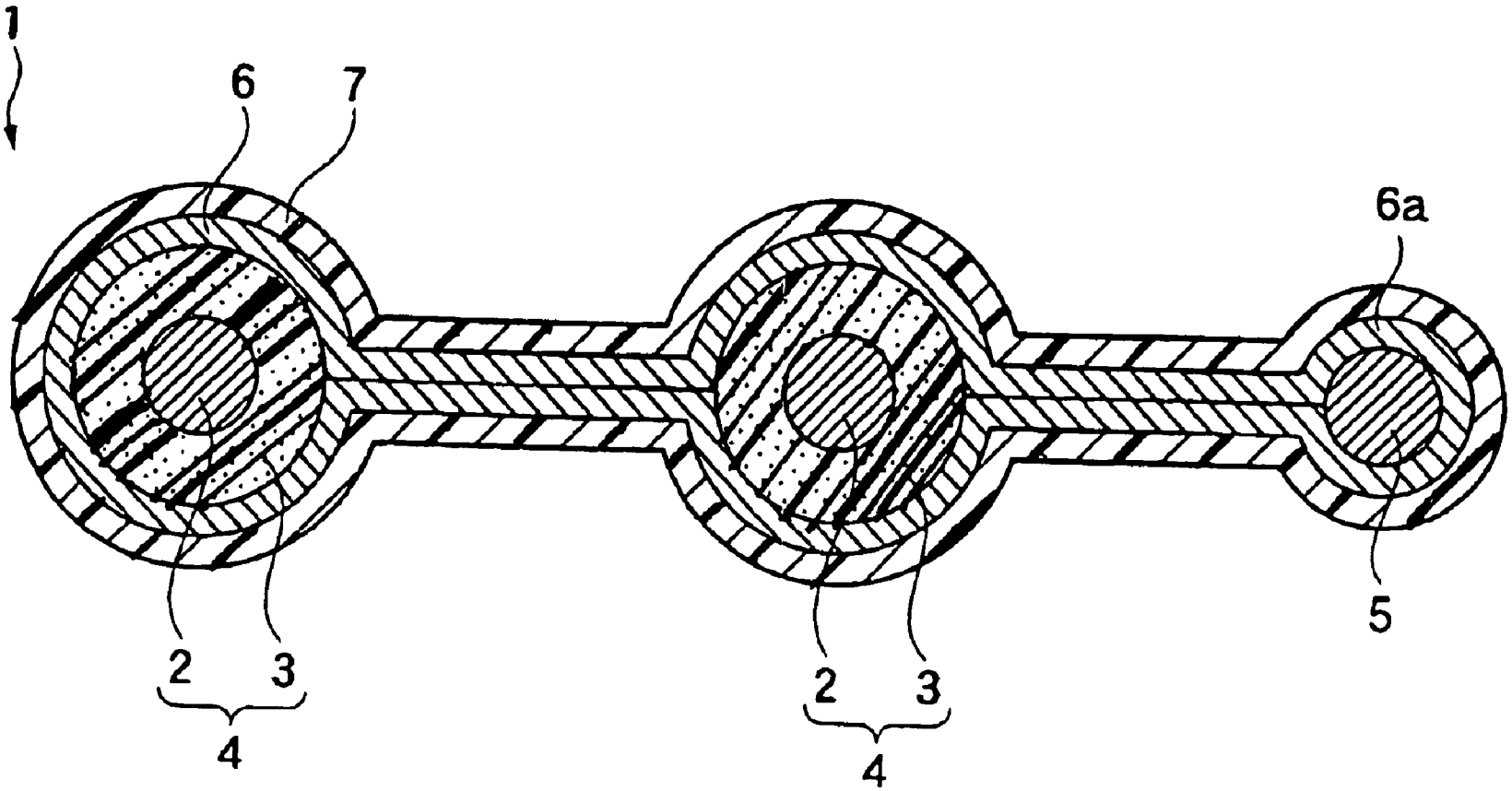
FIG. 1 is a cross-sectional view of a flat shielded cable 1 in accordance with a first embodiment.
Figure 2:
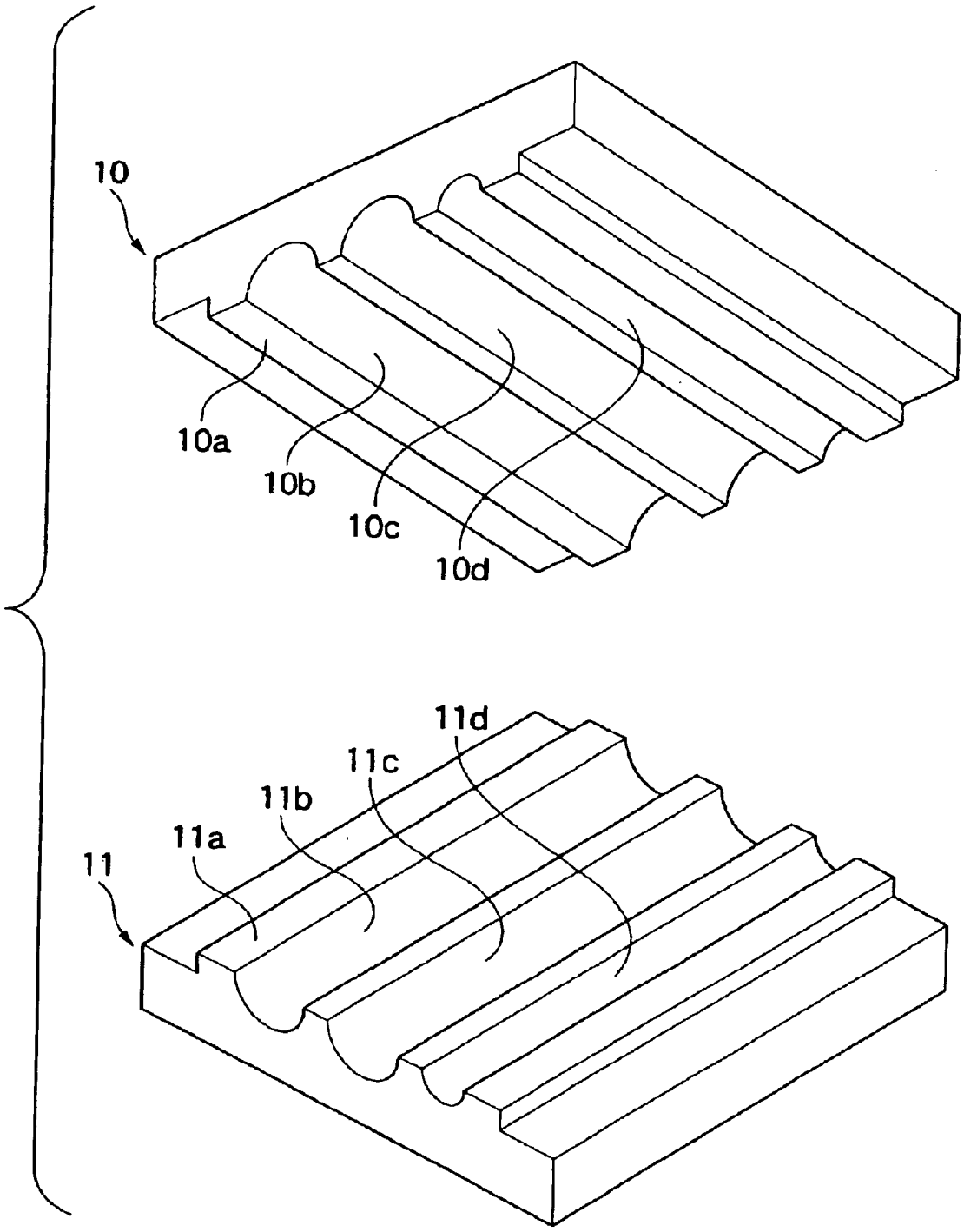
FIG. 2 is a perspective view of a pair of resin members in accordance with the first embodiment.
Figure 3:
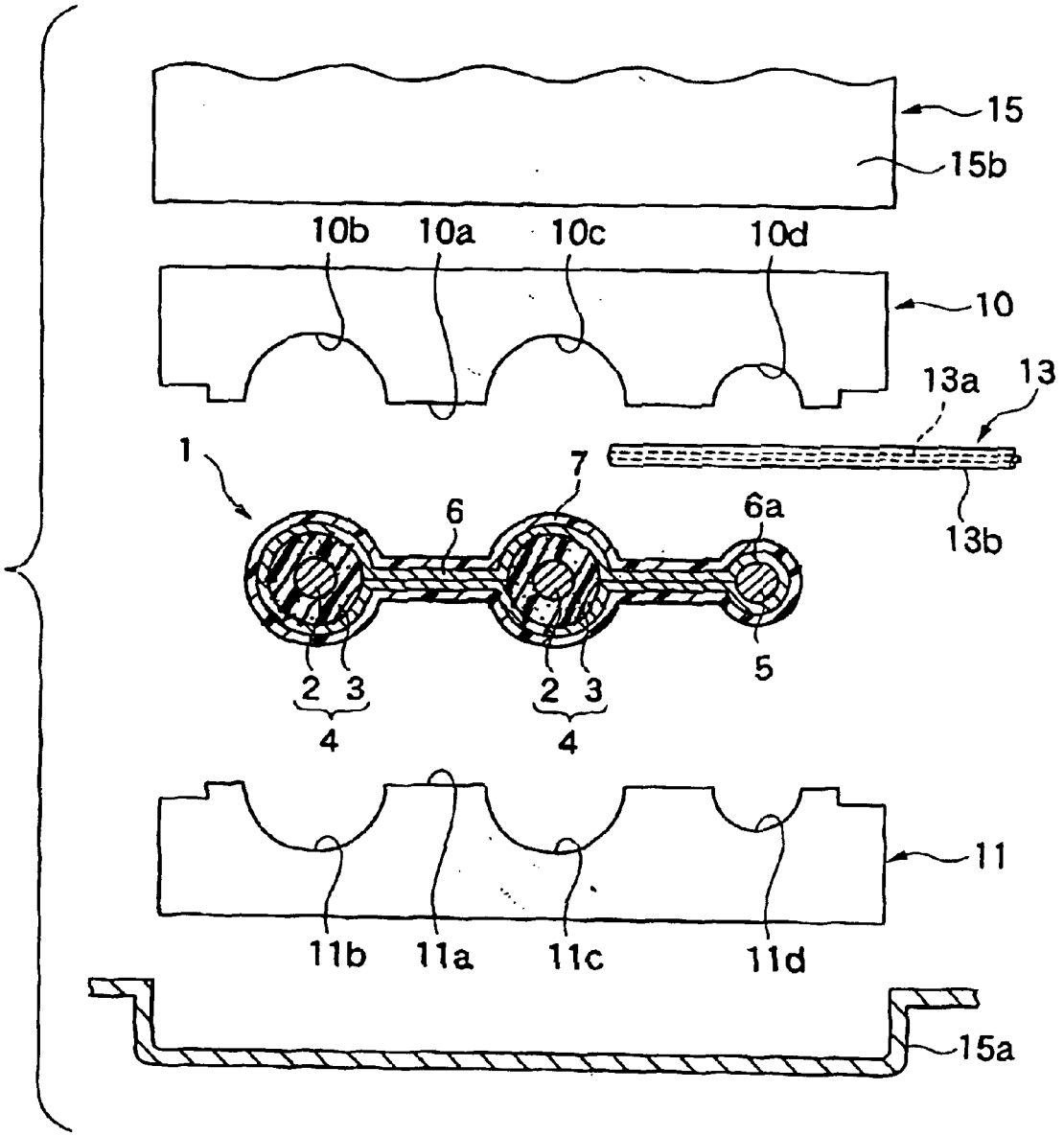
FIG. 3 is a diagram illustrating the relationship of layout of the respective members at the time of ultrasonic vibration in accordance with the first embodiment.
Figure 4:
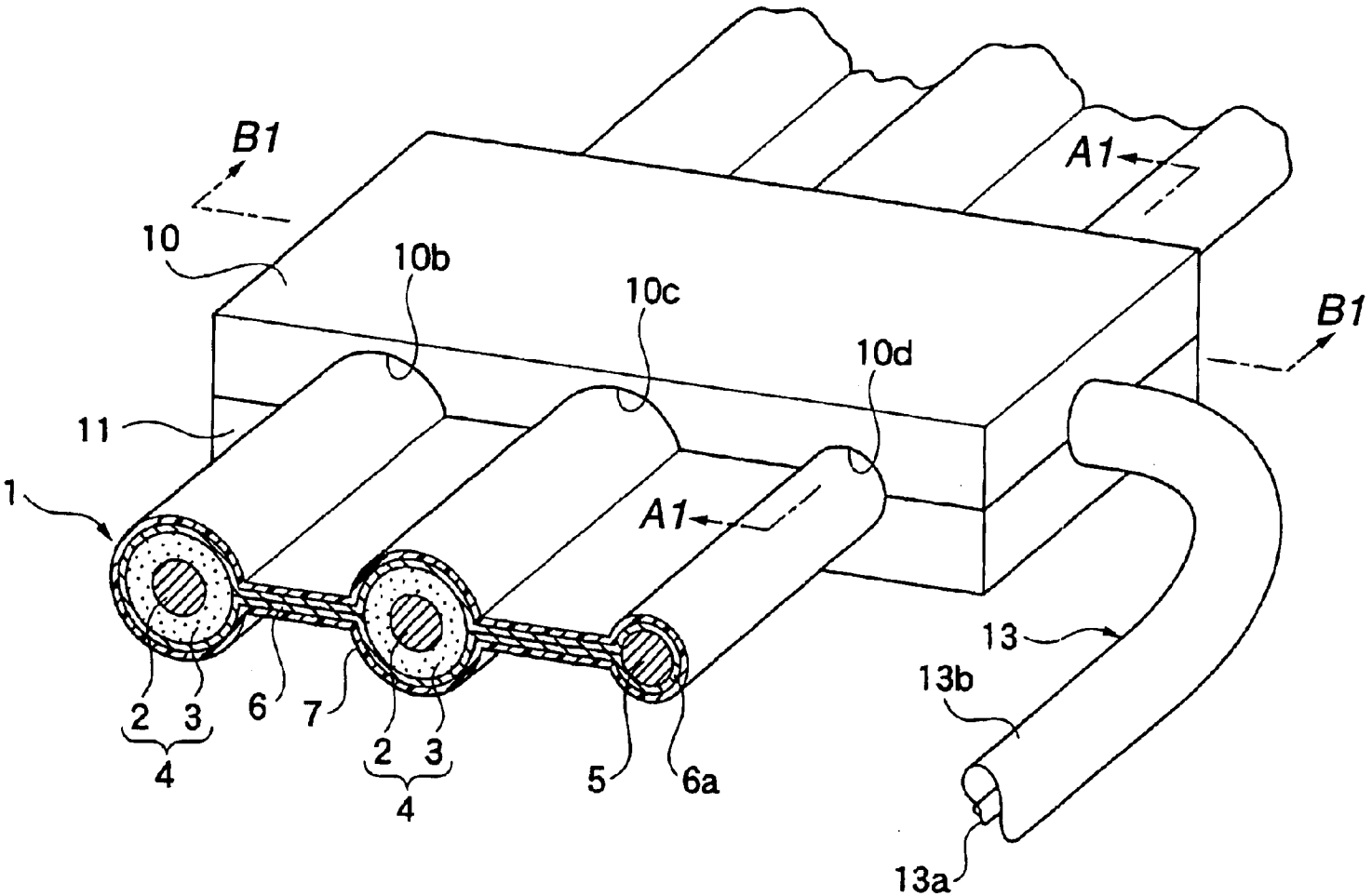
FIG. 4 is a perspective view of the flat shielded cable provided with a shield processing structure in accordance with the first embodiment.
Figure 5:
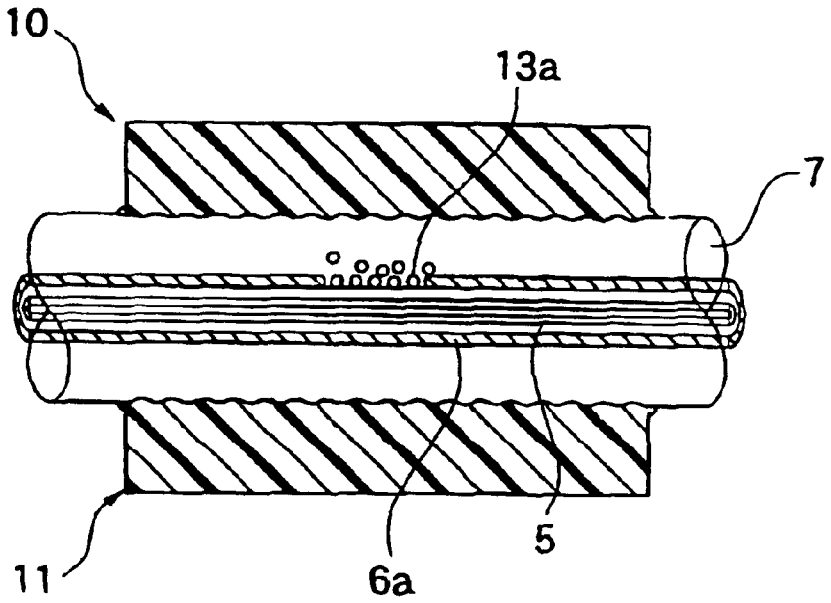
FIG. 5 is a cross-sectional view taken along line A1—A1 in FIG. 4 in accordance with the first embodiment.
Figure 6:
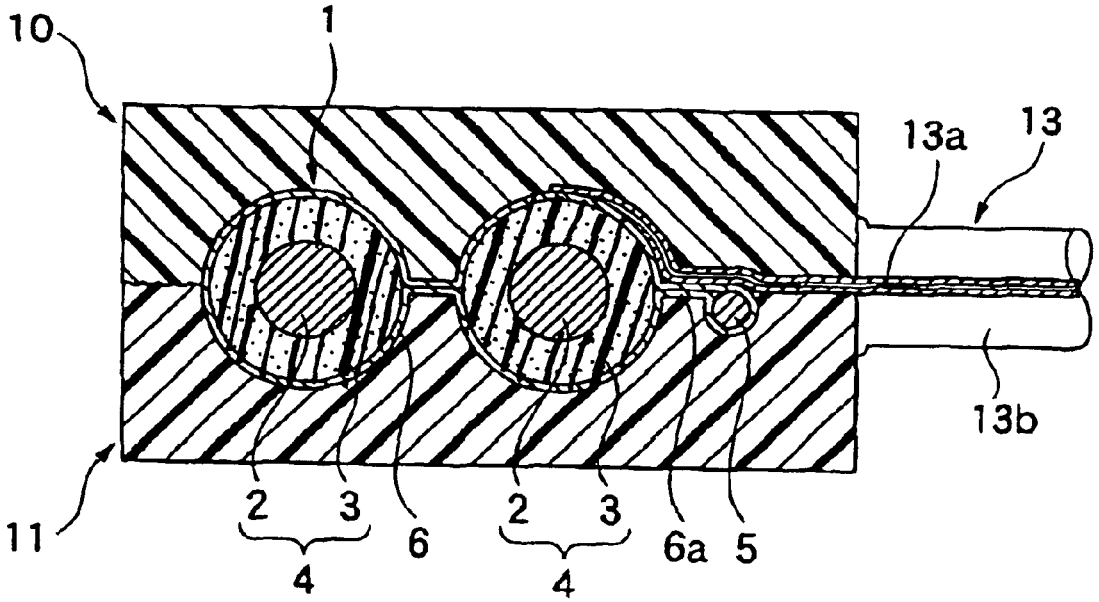
FIG. 6 is a cross-sectional view taken along line B1—B1 in FIG. 4 and illustrates the first embodiment.

FIGS. 1 to 6 illustrate a first embodiment of the invention. FIG. 1 is a cross-sectional view of a flat shielded cable 1; FIG. 2 is a perspective view of a pair of resin members 10 and 11; FIG. 3 is a diagram illustrating the relationship of layout of the respective members at the time of ultrasonic vibration; FIG. 4 is a perspective view of the flat shielded cable 1 provided with a shield processing structure, and FIG. 5 is a cross-sectional view taken along line A1—A1 in FIG. 4; and FIG. 6 is a cross-sectional view taken along line B1—B1 in FIG. 4.

The shield processing structure is for electrically connecting an aluminum foil shield member 6 of the flat shielded cable 1 to a conductor 13*a* of a grounding wire 13 by using the pair of resin members 10 and 11 by means of an ultrasonic horn 15 (ultrasonic generator), and a detailed description thereof will be given hereinafter.

As shown in FIG. 1, the flat shielded cable 1 is comprised of two shielded cores 4 in which cores 2 are respectively covered with insulating inner jackets 3 and which are arranged in parallel; a drain wire 5 arranged similarly in parallel to the two shielded cores 4 at a position on an outer side thereof; the aluminum foil shield member 6 which is a conductive shield cover member for covering the outer peripheries of the two shielded cores 4 and for covering the drain wire 5 at a grounding wire-use contact portion 6*a* provided on the outer side in the juxtaposing direction; and an insulating outer jacket 7 for covering the outer periphery of the aluminum foil shield member 6. The insulating inner jackets 3 and the insulating outer jacket 7 are formed of a synthetic resin-made insulator. The cores 2 and the drain wire 5 are formed of conductors in the same way as the aluminum foil member 6.

As shown in FIG. 2, the pair of resin members 10 and 11 are respectively synthetic resin-made blocks of the same shape and wider than the width of the flat shielded cable 1. Recesses 10*b*, 10*c*, 10 *d*, 11*b*, 11*c*, and 11*d* are respectively formed in the resin members 10 and 11 in a state in which their respective joining surfaces 10*a* and 11*a* abut against each other. Holes substantially corresponding to the outer shapes and cross-sectional shapes of the portions of the flat shielded cable 1 at the respective shielded cores 4 and at the drain wire 5 are formed on the recesses. Specifically, the recesses 10*b*, 10*c*, 11*b*, and 11*c* are substantially semicircular arc-shaped grooves in each of which the predetermined radius of the outer shape of the shielded core 4 is set as its radius. Specifically, the recesses 10*d* and 11*d* are substantially semicircular arc-shaped grooves in each of which the radius of the outer shape of the portion of the drain wire 5 is set as its radius.

There in members 10 and 11 in terms of their physical properties are less susceptible to melting than the insulating outer jacket 7 and the like, are selected from among an acrylic resin, an acrylonitrile butadiene styrene (ABS) copolymer base resin, a polycarbonate (PC) base resin, a polyethelene (PE) base resin, a polyether-imide (PEI) base resin, a polybutylene terephthalate (PBT) base resin, and the like, and are harder than vinyl chloride which is generally used for the insulating outer jacket 7 and the like. In terms of conductivity and safety in conductivity, utility is required for all the above-listed resins. If a judgment is made by taking into consideration the appearance and the insulating property, the polyether-imide (PEI) base resin and the polybutylene terephthalate (PBT) base resin are particularly suitable.

As shown in FIG. 3, the grounding wire 13 is comprised of the conductor 13*a* and an insulating outer jacket 13*b* covering the outer periphery thereof.

As shown in FIG. 3, the ultrasonic horn 15 is comprised of a lower supporting base 15*a* capable of positioning the resin member 11 disposed there below and an ultrasonic horn body 15*b* disposed immediately above this lower supporting base 15*a* and capable of applying ultrasonic vibration while exerting a downward pressing force.

Next, the shield processing procedure will be described. As shown in FIG. 3, the lower resin member 11 is disposed on the lower supporting base 15*a* of the ultrasonic horn 15, a portion of the flat shielded cable 1 in the vicinity of its end is placed thereon, one end side of the grounding wire 13 is further placed thereon, and the upper resin member 10 is then placed thereon. Thus the flat shielded cable 1 is placed in the recesses 10*b*, 10*c*, 10*d*, 11*b*, 11*c*, and 11*d* of the pair of resin members 10 and 11, and one end side of the grounding wire 13 is interposed between the upper resin member 10 and a position over both the grounding wire-use contact portion 6*a* and the drain wire 5 of this flat shielded cable 1.

Next, the ultrasonic horn body 15*b* is lowered, and vibration is applied to the pair of resin members 10 and 11 by the ultrasonic horn 15 while a compressive force is being applied across them. Then the insulating outer jacket 7 of the flat shielded cable 1 and the insulating outer jacket 13*b* of the grounding wire 13 are melted and scattered by the internal heat generation of the vibrational energy, and the conductor 13*a* of the grounding wire 13 and the aluminum foil shield member 6 and the drain wire 5 of the flat shielded cable 1 are brought into electrical contact with each other (see FIGS. 5 and 6). Contact portions of the joining surfaces 10*a* and 11*a* of the pair of resin members 10 and 11, the portions of contact between the inner peripheral surfaces of the recesses 10*b*, 10*c*, 10*d*, 11*b*, 11*c*, and 11*d* of the pair of resin members 10 and 11 and the insulating outer jacket 7 of the flat shielded cable 1, and the portions of contact between the insulating outer jacket 13*b* of the grounding wire 13 and the pair of resin members 10 and 11 are melted by the internal heat generation of the vibrational energy. As the result of the fact that these molten portions solidify after completion of the ultrasonic vibration, the pair of resin members 10 and 11, the flat shielded cable 1, and the grounding wire 13 are respectively fixed to each other (see FIG. 4).

As described above, according to this shield processing structure for a flat shielded cable and this shield processing method, when the flat shielded cable 1 is disposed between the pair of resin members 10 and 11, and one end side of the grounding wire 13 is interposed between the position above the grounding wire-use contact portion 6*a* of this flat shielded cable 1 and the upper resin member 10, and when ultrasonic vibration is applied across the pair of resin members 10 and 11 thus arranged, the insulating outer jackets 13*b* and 7 are melted and scattered by the internal heat generation of the vibrational energy, and the conductor 13*a* of the grounding wire 13 and the aluminum foil shield member 6 are brought into contact with each other. Accordingly, it is unnecessary to effect the operation of the jacket removal itself. Moreover, the shield processing can be effected in a simple process in which assembly is performed in the order of the lower resin member 11, the flat shielded cable 1, one end side of the grounding wire 13, and the upper resin member 10, followed by ultrasonic vibration. In addition, automation is made possible since the number of steps is thus small and intricate manual operation is not involved.

Second Embodiment

Figure 7:
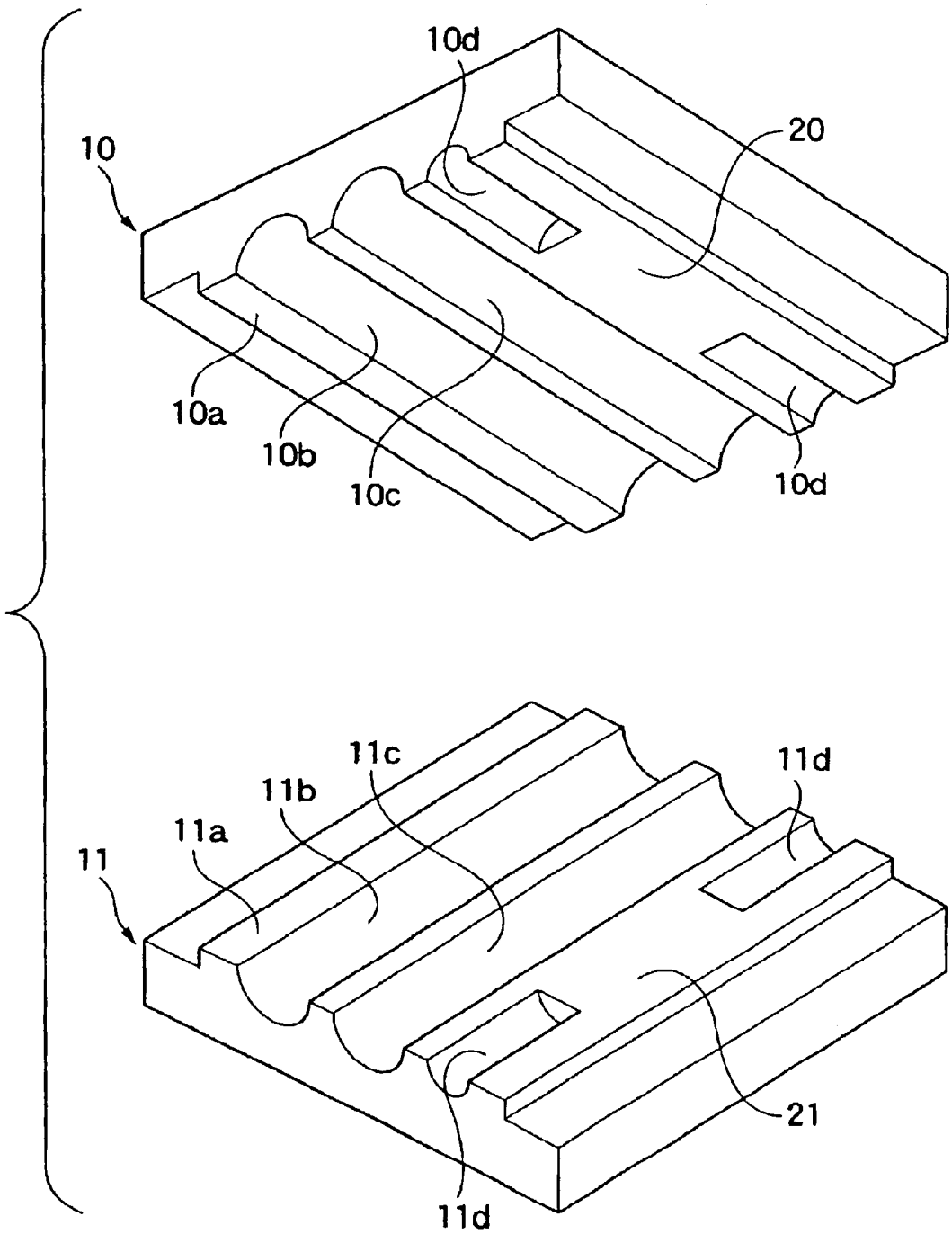
FIG. 7 is a perspective view of the pair of resin members in accordance with a second embodiment.
Figure 8:
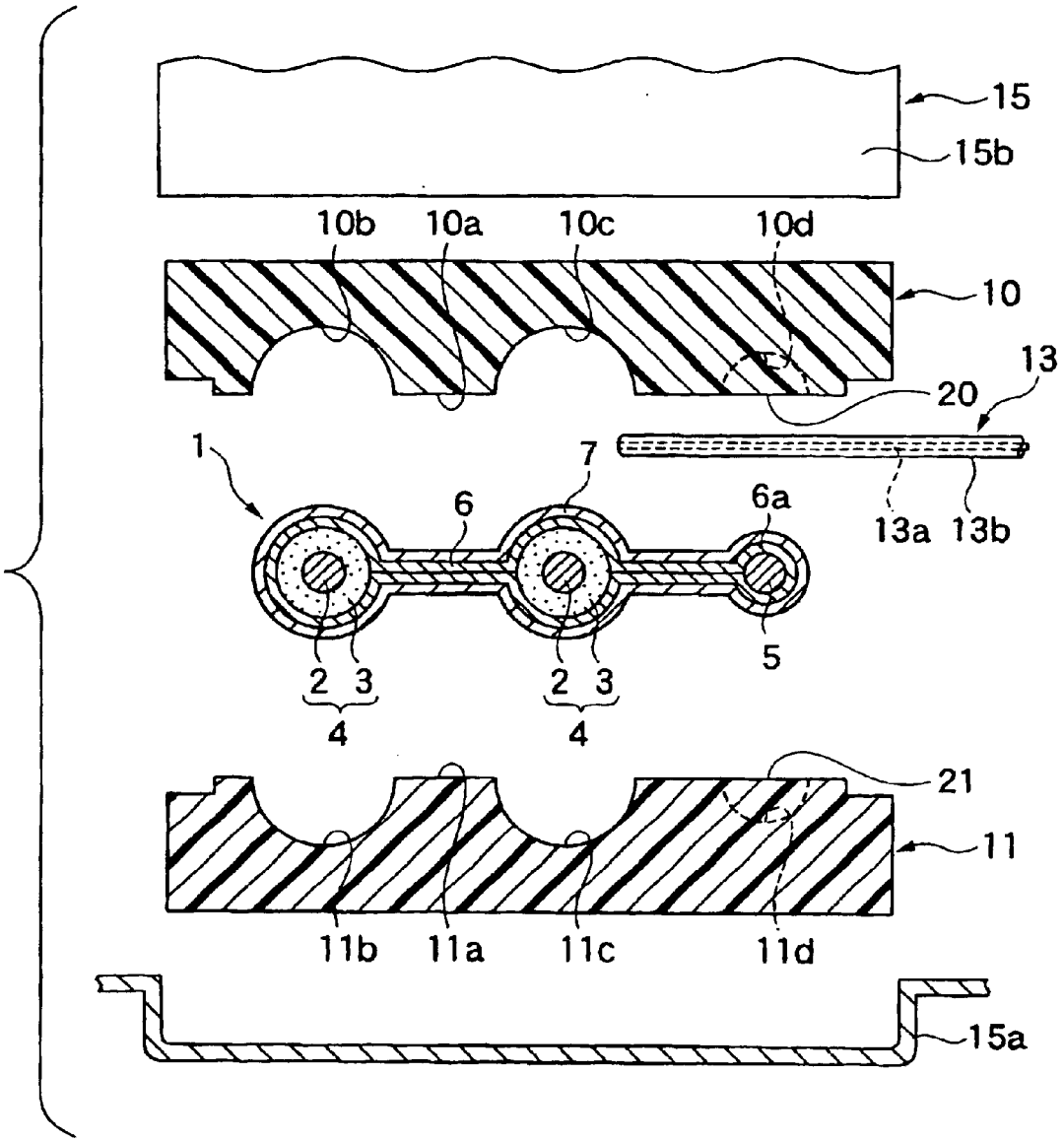
FIG. 8 is a diagram illustrating the relationship of layout of the respective members at the time of ultrasonic vibration in accordance with the second embodiment.
Figure 9:
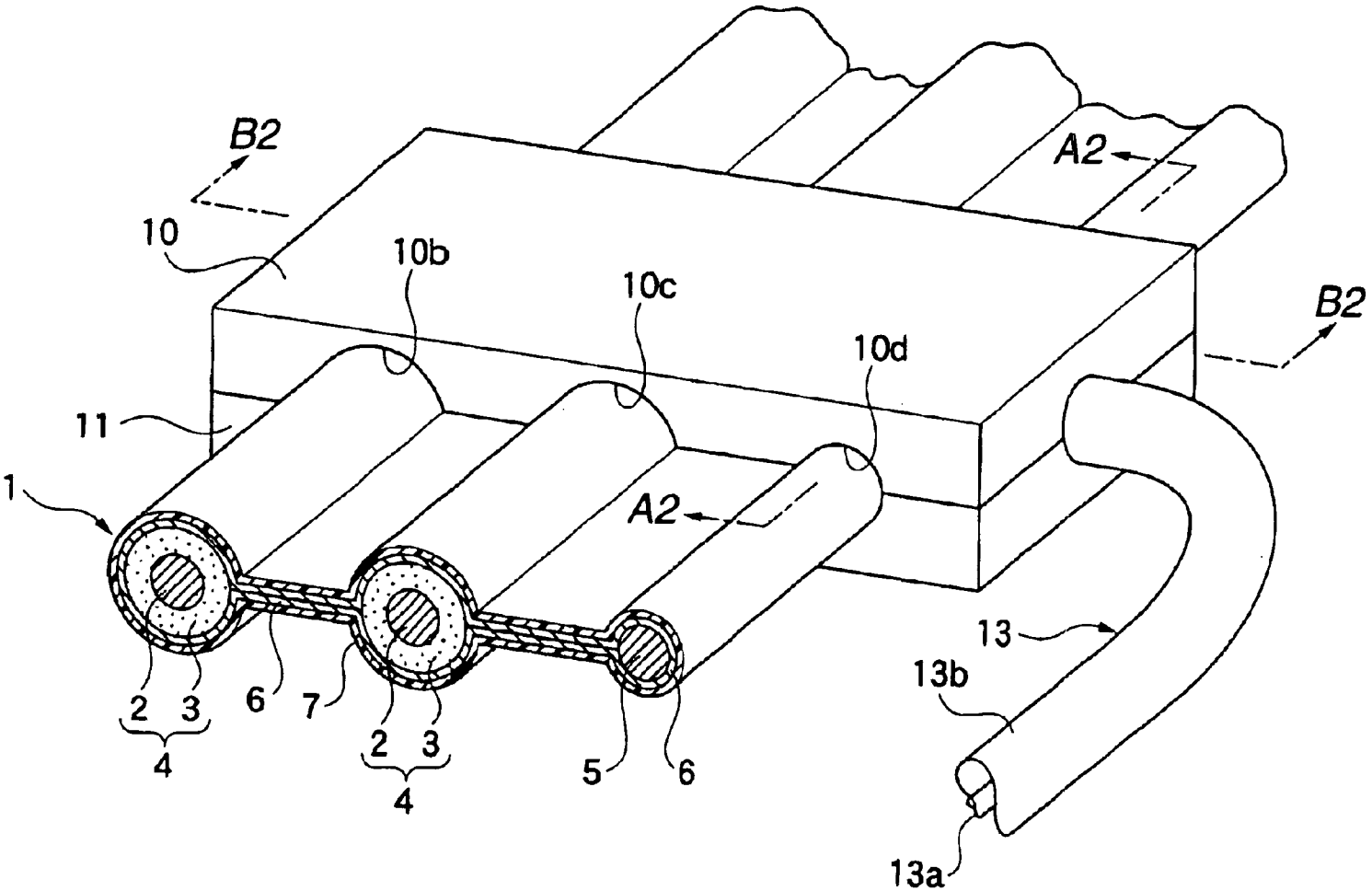
FIG. 9 is a perspective view of the flat shielded cable provided with the shield processing structure in accordance with the second embodiment.
Figure 10:
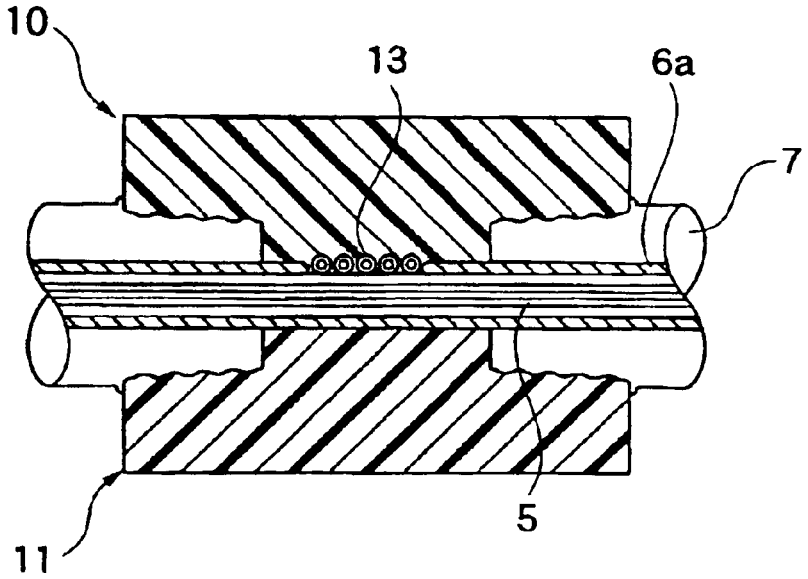
FIG. 10 is a cross-sectional view taken along line A2—A2 in FIG. 9 in accordance with the second embodiment.
Figure 11:
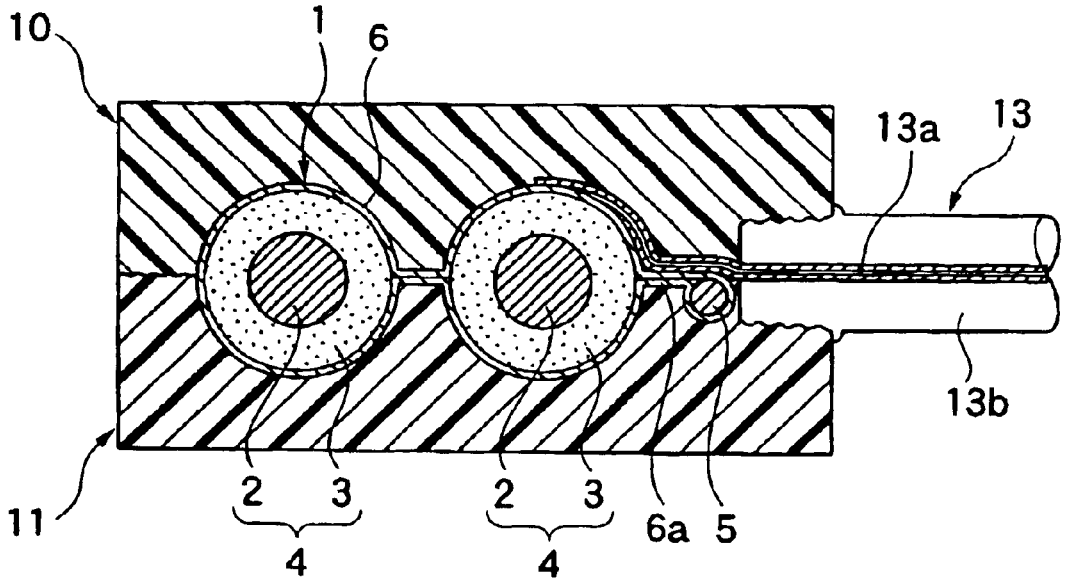
FIG. 11 is a cross-sectional view taken along line B2—B2 in FIG. 9 and illustrates the second embodiment.

FIGS. 7 to 11 illustrate a second embodiment of the invention. FIG. 7 is a perspective view of the pair of resin members 10 and 11; FIG. 8 is a diagram illustrating the relationship of layout of the respective members at the time of ultrasonic vibration; FIG. 9 is a perspective view of the flat shielded cable 1 provided with the shield processing structure; FIG. 10 is a cross-sectional view taken along line A2—A2 in FIG. 9; and FIG. 11 is a cross-sectional view taken along line B2—B2 in FIG. 9.

Since this second embodiment has a construction substantially similar to that of the above-described first embodiment, identical constituent portions will be denoted by the same reference numerals in the drawings, a description thereof will be omitted, and only different constituent portions will be described.

Namely, the sole difference lies in that, in the respective joining surfaces 10*a* and 11*a* of the pair of resin members 10 and 11, portions where the grounding wire-use contact portion 6a of the flat shielded cable 1 and the grounding wire 13 are both disposed are respectively formed as flat surfaces 20 and 21 for pressing the grounding wire-use contact portion 6*a* and the grounding wire 13 in a state in which the respective joining surfaces 10*a* and 11*a* abut against each other.

In this second embodiment as well, in the same way as in the above-described first embodiment, it is unnecessary to effect the operation itself of removing the jacket of the flat shielded cable 1 or the like. Moreover, the shield processing can be effected in a simple process in which assembly is performed in the order of the lower resin member 11, the flat shielded cable 1, one end side of the grounding wire 13, and the upper resin member 10, followed by ultrasonic vibration. In addition, automation is made possible since the number of steps is thus small and intricate manual operation is not involved.

In addition, in this second embodiment, when the pair of resin members 10 and 11 compress the grounding wire-use contact portion 6*a* of the aluminum foil shield member 6 and the grounding wire 13 by their flat surfaces 20 and 21, and the vibrational energy of ultrasonic vibration is applied thereto in this compressed state, as shown in FIG. 10, the insulating outer jackets 13*b* and 7 are melted and scattered while the conductor 13*a* of the grounding wire 13 is expanded by the compressive force, so that the conductor 13*a* of the grounding wire 13 in the expanded state is connected to the aluminum foil shield member 6. Accordingly, numerous points of contact are obtained between the grounding wire 13 and the aluminum foil shield member 6, thereby improving the reliability of electric characteristics in connection.

Third Embodiment

Figure 12:
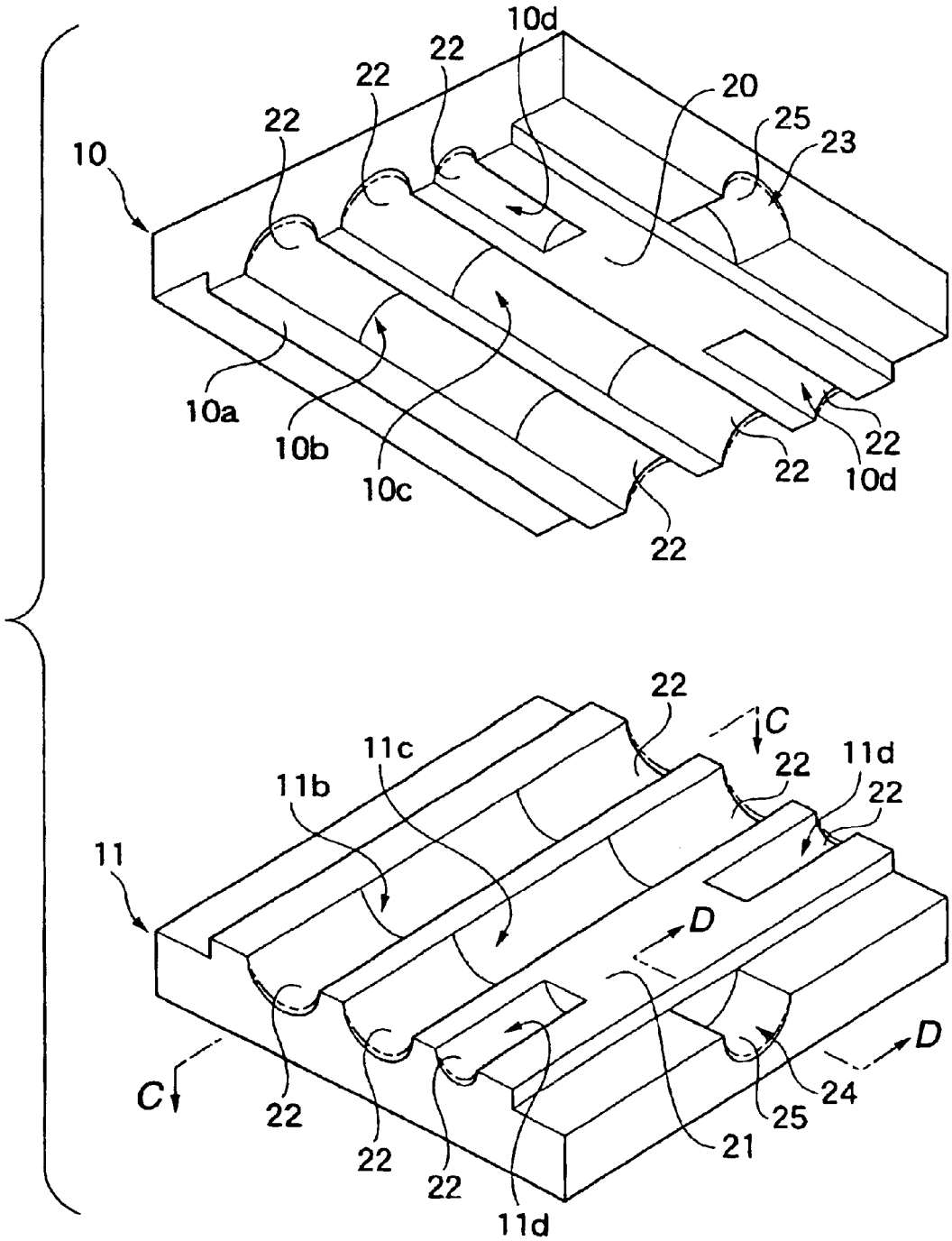
FIG. 12 is a perspective view of the pair of resin members in accordance with a third embodiment.
Figure 13:
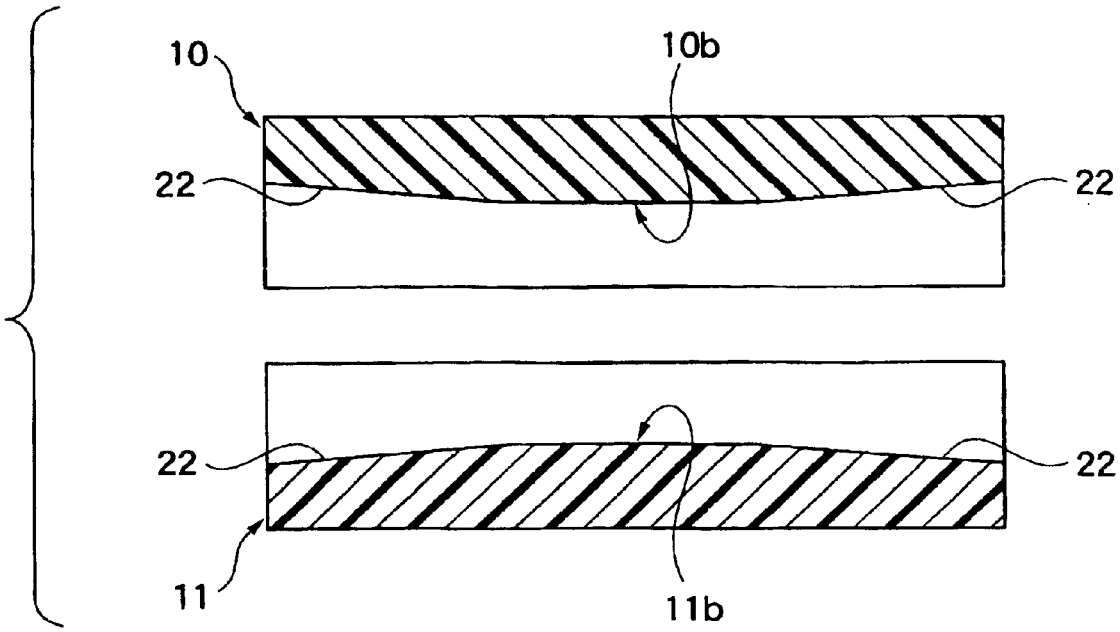
FIG. 13 is a cross-sectional view taken along line C—C in FIG. 12 and illustrates the third embodiment.
Figure 14:
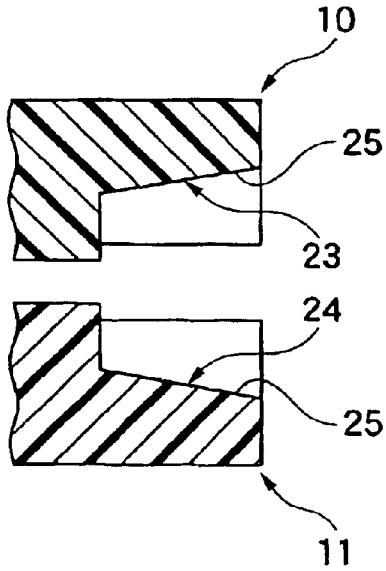
FIG. 14 is a cross-sectional view taken along line D—D in FIG. 12 and illustrates the third embodiment.
Figure 15:
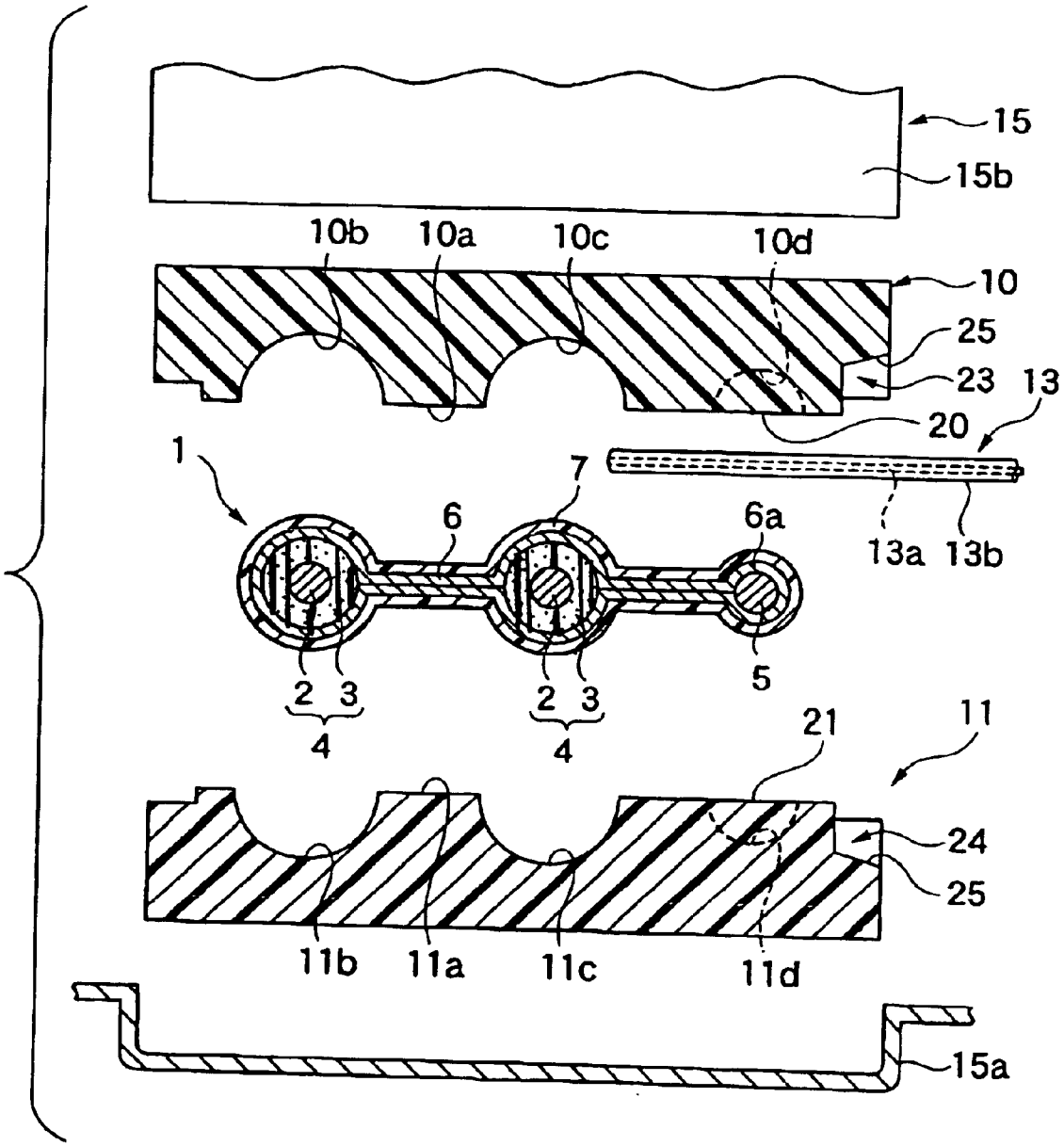
FIG. 15 is a diagram illustrating the relationship of layout of the respective members at the time of ultrasonic vibration in accordance with the third embodiment.
Figure 16:
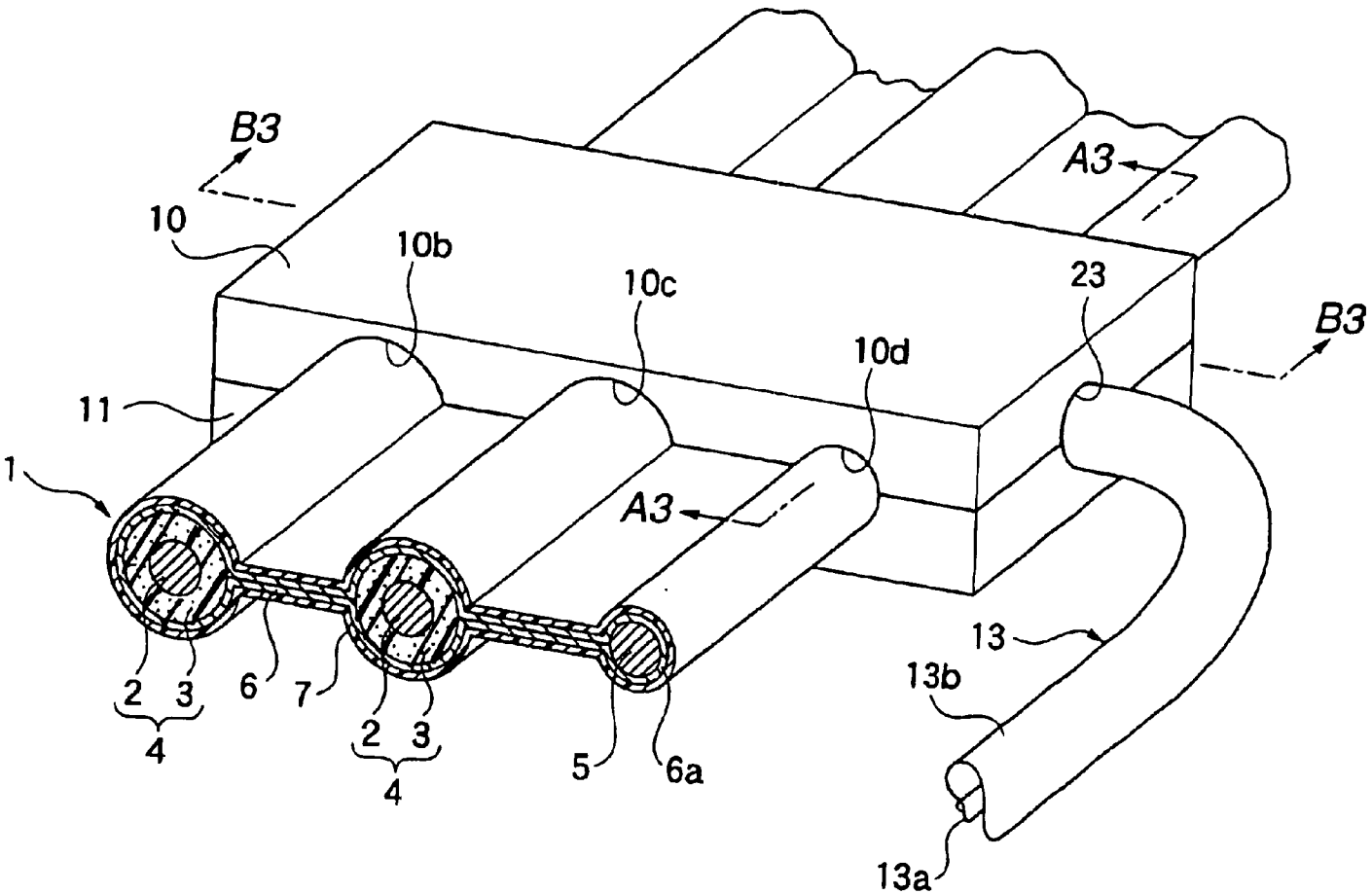
FIG. 16 is a perspective view of the flat shielded cable provided with the shield processing structure in accordance with the third embodiment.
Figure 17:
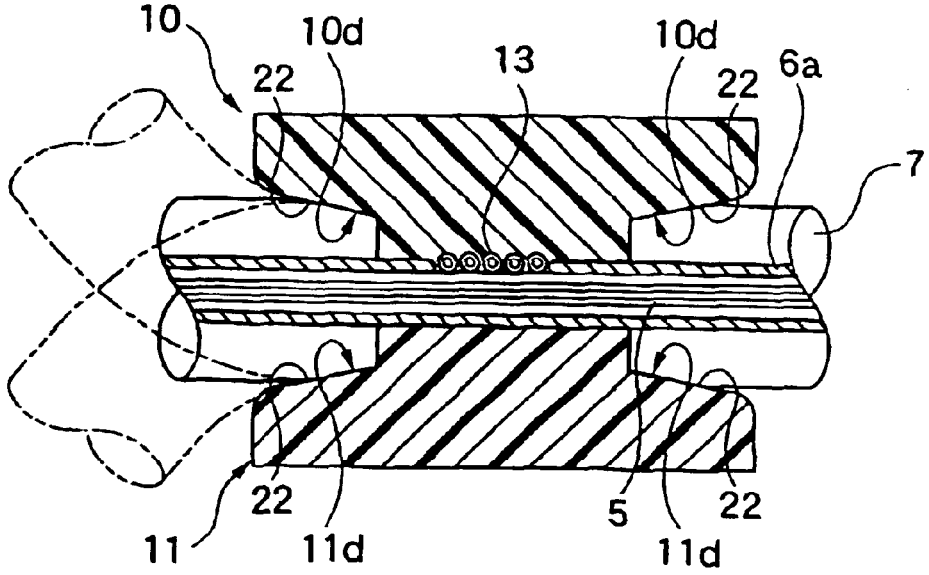
FIG. 17 is a cross-sectional view taken along line A3—A3 in FIG. 16 in accordance with the third embodiment.
Figure 18:
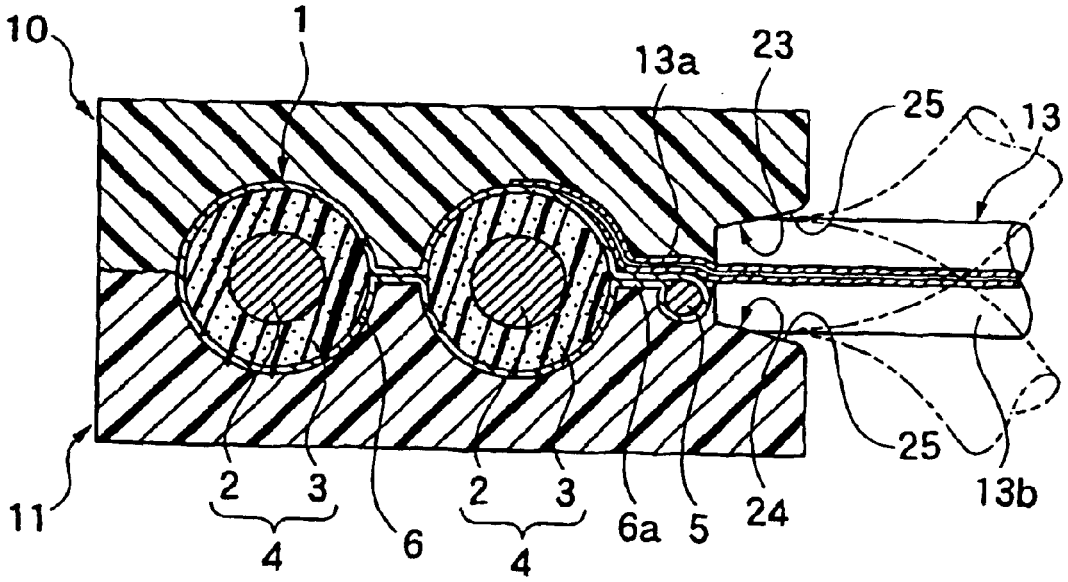
FIG. 18 is a cross-sectional view taken along line B3—B3 in FIG. 16 and illustrates the third embodiment.

FIGS. 12 to 18 illustrate a third embodiment of the invention. FIG. 12 is a perspective view of the pair of resin members 10 and 11; FIG. 13 is a cross-sectional view taken along line C—C in FIG. 12; FIG. 14 is a cross-sectional view taken along line D—D in FIG. 12; FIG. 15 is a diagram illustrating the relationship of layout of the respective members at the time of ultrasonic vibration; FIG. 16 is a perspective view of the flat shielded cable 1 provided with the shield processing structure; FIG. 17 is a cross-sectional view taken along line A3—A3 in FIG. 16, and FIG. 18 is a cross-sectional view taken along line B3—B3 in FIG. 16.

Since this third embodiment has a construction substantially similar to that of the above-described second embodiment, identical constituent portions will be denoted by the same reference numerals in the drawings, a description thereof will be omitted, and only different constituent portions will be described.

Namely, as shown in detail in FIGS. 12 and 13, the inner peripheral surfaces of the recesses 10*b*, 10*c*, 10*d*, 11*b*, 11*c*, and 11*d* of the pair of resin members 10 and 11 are formed as tapered surfaces 22 such that the diameter of each of these inner peripheral surfaces on the exit side of the flat shielded cable 1 is gradually enlarged from the inner side toward the outer side. In addition, in the respective joining surfaces 10*a* and 11*a* of the pair of resin members 10 and 11 on the exit side of the grounding wire 13, as shown in detail in FIGS. 12 and 14, grounding wire-accommodating grooves 23 and 24 are respectively provided whereby a hole whose diameter is larger than that of the grounding wire 13 is formed with the respective joining surfaces 10*a* and 11*a* abutting against each other. Further, the inner peripheral surfaces of these grounding wire-accommodating grooves 23 and 24 are formed as tapered surfaces 25 such that the diameter of each of these inner peripheral surfaces on the exit side of the grounding wire 13 is gradually enlarged from the inner side toward the outer side. These are the sole differences with the above-described second embodiment. Incidentally, in FIG. 12, the inner peripheral surfaces of the recesses 10*b*, 10*c*, 10*d*, 11*b*, 11*c*, and 11*d* in the case of the semicircular shapes as in the second embodiment are shown by phantom lines to clarify the tapered surfaces 22 and 25.

In this third embodiment as well, in the same way as in the above-described first and second embodiments, it is unnecessary to effect the operation itself of removing the jacket of the flat shielded cable 1 or the like. Moreover, the shield processing can be effected in a simple process in which assembly is performed in the order of the lower resin member 11, the flat shielded cable 1, one end side of the grounding wire 13, and the upper resin member 10, followed by ultrasonic vibration. In addition, automation is made possible since the number of steps is thus small and intricate manual operation is not involved.

In addition, in this third embodiment, since the inner peripheral surfaces of the recesses 10*b*, 10*c*, 10*d*, 11*b*, 11*c*, and 11*d* of the pair of resin members 10 and 11 are formed as tapered surfaces 22, the compressive force applied to the insulating outer jacket 7 by the pair of resin members 10 and 11 is weak on the exit sides of the shielded cores 4 by virtue of the tapered surfaces 22, and the transmission of the vibrational energy by the ultrasonic vibration is suppressed. Therefore, it is possible to prevent the dielectric breakdown of the shielded cores 4, and the insulation performance of the flat shielded cable 1 and the strength of the flat shielded cable 1 improve. In addition, even if the flat shielded cable 1 is bent after ultrasonic welding as shown by the phantom lines in FIG. 17, the breakage of the insulating outer jacket 7 due to the edge effect is suppressed by the tapered surfaces 22 on the exit sides of the shielded cores 4, so that the breakage of the insulating outer jacket of the shielded cores 4 can be prevented. This also improves the insulation performance of the flat shielded cable 1 and the strength of the flat shielded cable 1. It should be noted that although, in this third embodiment, the inner peripheral surfaces of the recesses 10*d* and 11*d* for the drain wire 5 are also formed as the tapered surfaces 22, the inner peripheries of these recesses 10*d* and 11*d* may not be formed as the tapered surfaces 22. In other words, this is because even if they are not formed as the tapered surfaces 22, the arrangement has no relevance to the improvement of the insulation performance of the flat shielded cable 1. It should be noted, however, that if these surfaces are formed as the tapered surfaces 22, the arrangement contributes to the suppression of the breakage of the insulating outer jacket 7 due to the edge effect, so that it contributes to the improvement of the strength of the flat shielded cable 1.

In addition, in this third embodiment, the grounding wire-accommodating grooves 23 and 24 are respectively provided in the pair of resin members 10 and 11, and the inner peripheral surfaces of these grounding wire-accommodating grooves 23 and 24 are formed as the predetermined tapered surfaces 25. Therefore, the transmission of the vibrational energy by the ultrasonic vibration is suppressed on the exit side of the grounding wire 13 by the grounding wire-accommodating grooves 23 and 24 and their tapered surfaces 25, so that it is possible to prevent the dielectric breakdown of the grounding wire 13, thereby improving the insulation performance of the grounding wire 13. In addition, even if the grounding wire 13 is bent after ultrasonic welding as shown by the phantom lines in FIG. 18, the breakage of the insulating outer jacket 13*b* due to the edge effect is suppressed by the tapered surfaces 25 on the exit side of the grounding wire 13, which also makes it possible to prevent the breakage of the insulating outer jacket of the grounding wire 13 and improves the strength of the grounding wire 13.

Fourth Embodiment

Figure 19:
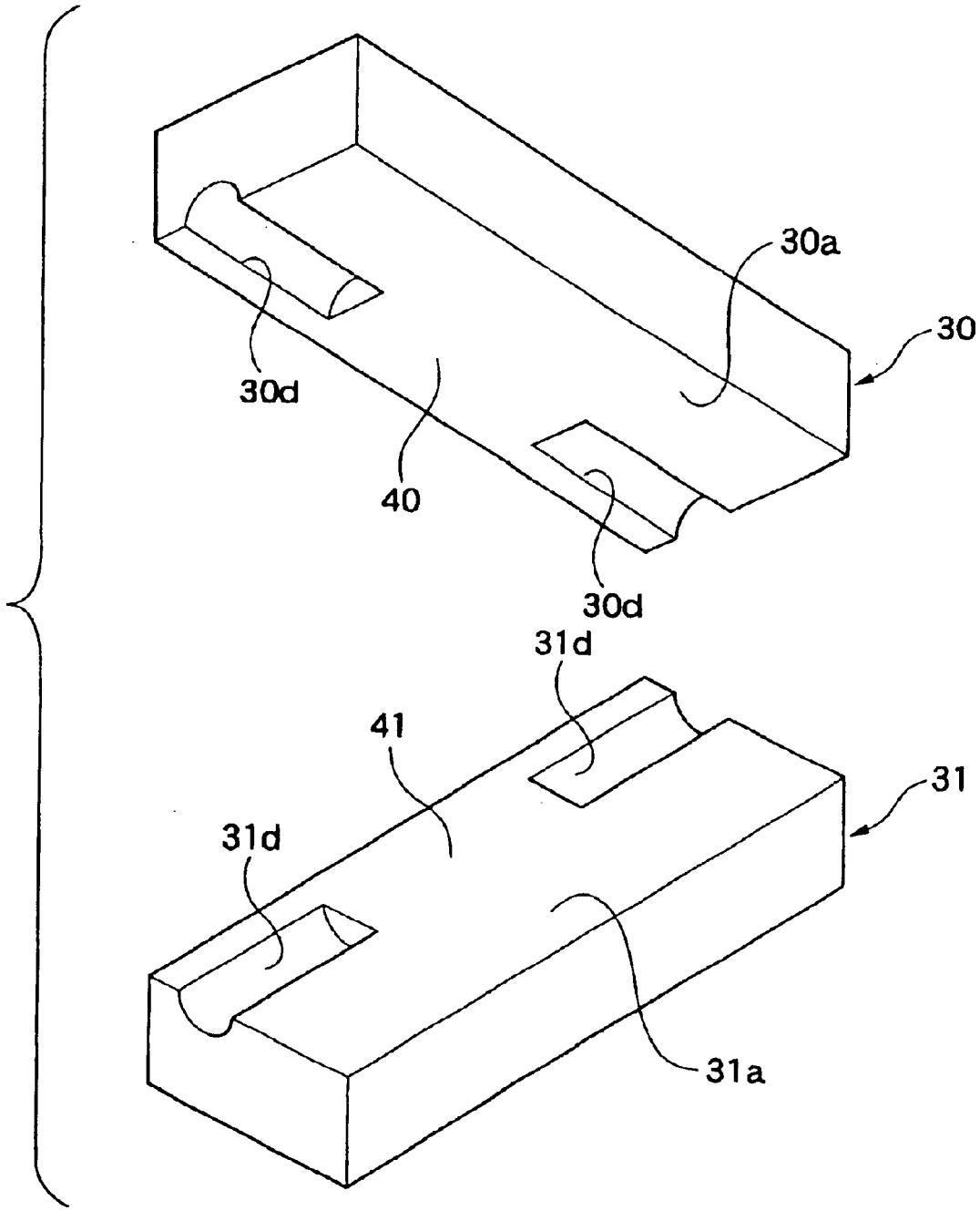
FIG. 19 is a perspective view of the pair of resin members in accordance with a fourth embodiment.
Figure 20:
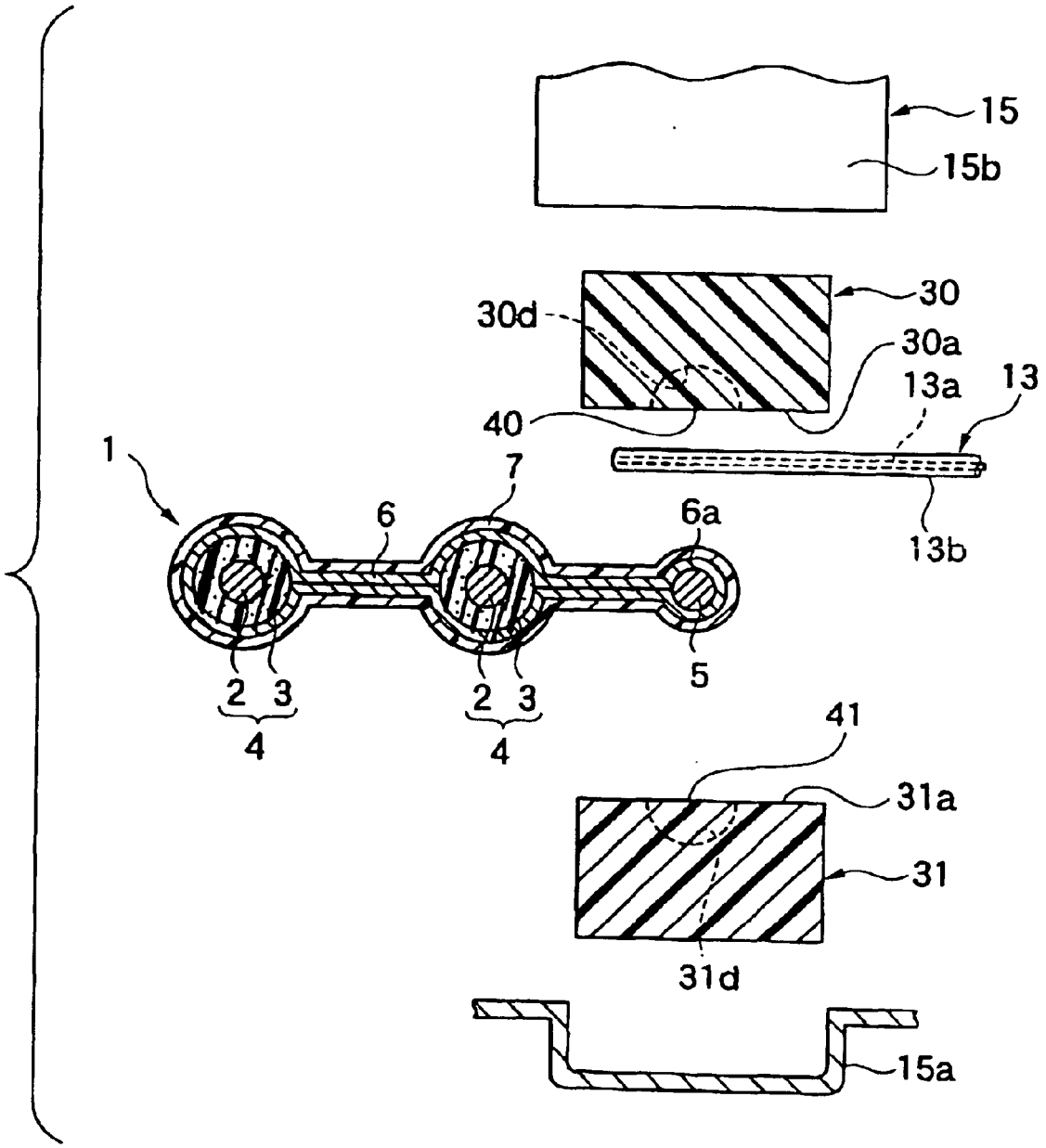
FIG. 20 is a diagram illustrating the relationship of layout of the respective members at the time of ultrasonic vibration in accordance with the fourth embodiment.
Figure 21:
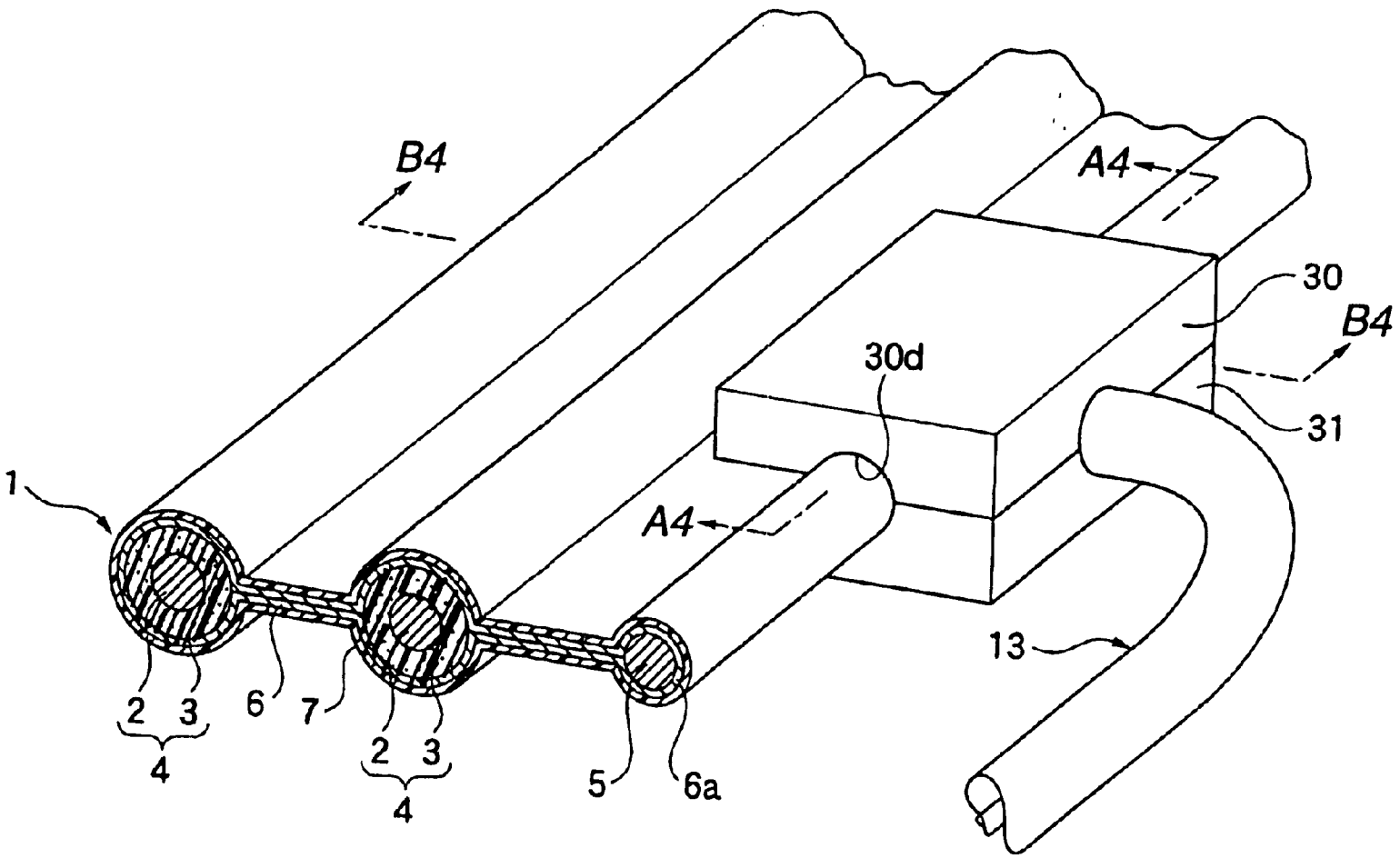
FIG. 21 is a perspective view of the flat shielded cable provided with the shield processing structure in accordance with the fourth embodiment.
Figure 22:
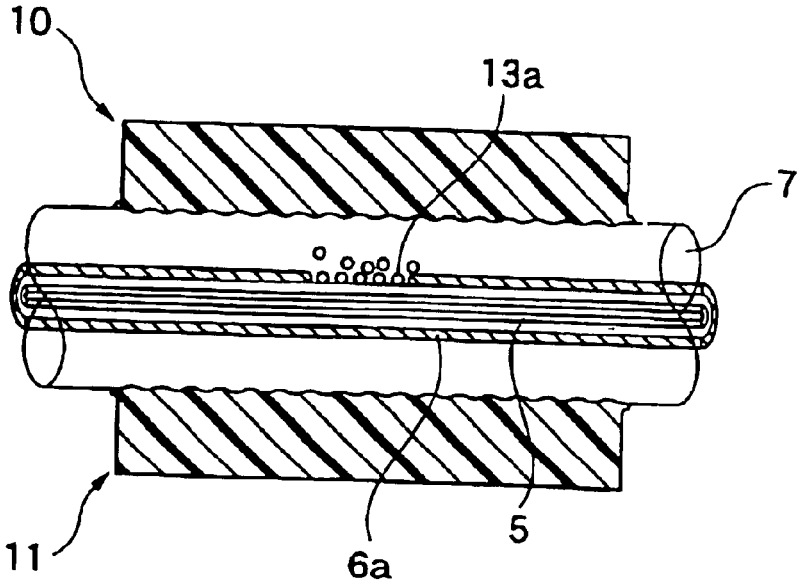
FIG. 22 is a cross-sectional view taken along line A4—A4 in FIG. 21 in accordance with the fourth embodiment.
Figure 23:
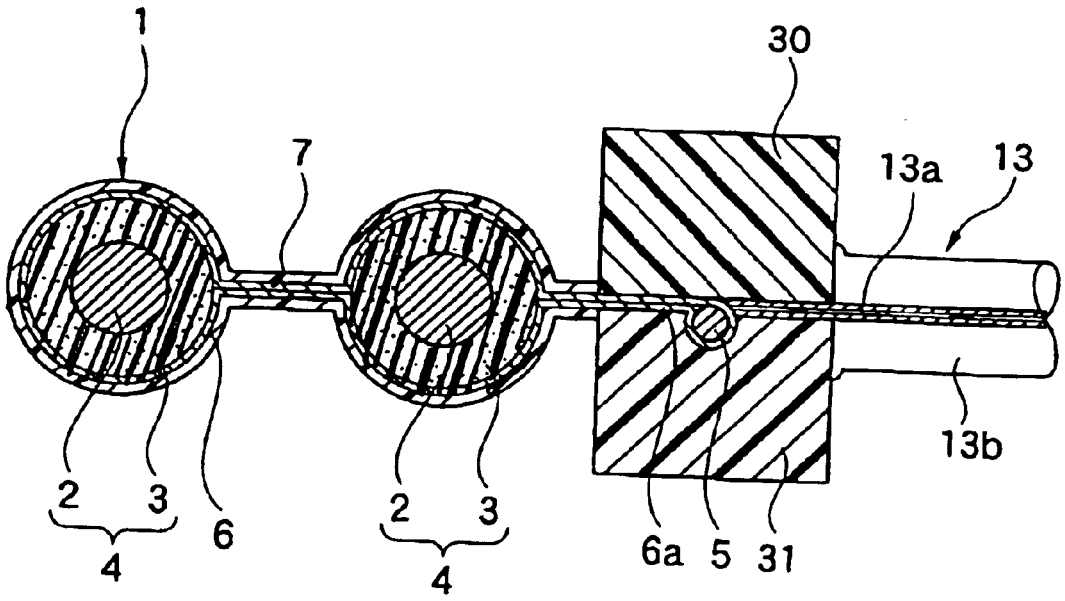
FIG. 23 is a cross-sectional view taken along line B4—B4 in FIG. 21 and illustrates the fourth embodiment.

FIGS. 19 to 23 illustrate a fourth embodiment of the invention. FIG. 19 is a perspective view of a pair of resin members 30 and 31; FIG. 20 is a diagram illustrating the relationship of layout of the respective members at the time of ultrasonic vibration; FIG. 21 is a perspective view of the flat shielded cable 1 provided with the shield processing structure; FIG. 22 is a cross-sectional view taken along line A4—A4 in FIG. 21, and FIG. 23 is a cross-sectional view taken along line B4—B4 in FIG. 21.

As compared with the above-described first to third embodiments, this fourth embodiment differs in the construction of the pair of resin members 30 and 31. Namely, although the pair of resin members 10 and 11 in the above-described first to third embodiments are provided more widely than the width of the flat shielded cable 1, the pair of resin members 30 and 31 in this fourth embodiment are provided more narrowly than the width of the flat shielded cable 1. Further, the pair of resin members 30 and 31 in this fourth embodiment are provided such that they do not contact the portions located on the outer sides of the respective shielded cores 4 of the flat shielded cable 1 with their joining surfaces 30*a* and 31*a* abutting against each other but contact only the portions located on the outer sides of the grounding wire-use contact portion 6*a*. A pair of recesses 30*d* and a pair of recesses 31*d* for forming holes substantially corresponding to the outer shape and cross-sectional shape of the portion at the drain wire 5 are respectively formed in the joining surfaces 30*a* and 31*a*, and portions where the grounding wire-use contact portion 6*a* of the flat shielded cable 1 and the grounding wire 13 are both disposed are formed as flat surfaces 40 and 41.

Since the other arrangements are similar to those of the above-described first to third embodiments, identical constituent portions will be denoted by the same reference numerals in the drawings, and a description thereof will be omitted.

Next, the shield processing procedure will be described. As shown in FIG. 19, the lower resin member 31 is disposed on the lower supporting base 15*a* of the ultrasonic horn 15, a portion of the flat shielded cable 1 in the vicinity of its end is placed thereon, one end side of the grounding wire 13 is further placed thereon, and the upper resin member 30 is then placed thereon. Thus the flat shielded cable 1 is placed in the recesses 30*d* and 31*d* of the pair of resin members 30 and 31, and one end side of the grounding wire 13 is interposed between the upper resin member 30 and a position over both the grounding wire-use contact portion 6*a* and the drain wire 5 of this flat shielded cable 1. Thus, in this state, only the portions located on the outer sides of the grounding wire-use contact portion 6a of the flat shielded cable 1 are clamped by the pair of resin members 30 and 31.

Next, the ultrasonic horn body 15*b* is lowered, and vibration is applied to the pair of resin members 30 and 31 by the ultrasonic horn 15 while a compressive force is being applied across them. Then the insulating outer jacket 7 of the flat shielded cable 1 and the insulating outer jacket 13*b* of the grounding wire 13 are melted and scattered by the internal heat generation of the vibrational energy, and the conductor 13*a* of the grounding wire 13, on the one hand, and the aluminum foil shield member 6 and the drain wire 5 of the flat shielded cable 1, on the other hand, are brought into electrical contact with each other (see FIGS. 22 and 23). In addition, contact portions of the joining surfaces 30*a* and 31*a* of the pair of resin members 30 and 31, the portions of contact between the inner peripheral surfaces of the recesses 30*d* and 31*d* of the pair of resin members 30 and 31 and the insulating outer jacket 7 of the flat shielded cable 1, and the portions of contact between the insulating outer jacket 13*b* of the grounding wire 13 and the pair of resin members 30 and 31 are melted by the internal heat generation of the vibrational energy. As the result of the fact that these molten portions solidify after completion of the ultrasonic vibration, the pair of resin members 30 and 31, the flat shielded cable 1, and the grounding wire 13 are respectively fixed to each other.

In this fourth embodiment as well, in the same way as in the above-described first to third embodiments, it is unnecessary to effect the operation itself of removing the jacket of the flat shielded cable 1 or the like. Moreover, the shield processing can be effected in a simple process in which assembly is performed in the order of the lower resin member 11, the flat shielded cable 1, one end side of the grounding wire 13, and the upper resin member 30, followed by ultrasonic vibration. In addition, automation is made possible since the number of steps is thus small and intricate manual operation is not involved.

In addition, in this fourth embodiment, since the pair of resin members 30 and 31 do not contact the insulating outer jacket 7 on the outer side of each shielded core 4, and the insulating outer jacket 7 in that portion is not melted by the ultrasonic vibration, the insulating outer jacket 7 on the outer side of each shielded core 4 is not broken or cut by the ultrasonic vibration, so that it is possible to prevent a decline in the cable strength.

In addition, in this fourth embodiment, since the pair of resin members 30 and 31 doe not clamp the portions located on the outer sides of the shielded cores 4 but clamp only the portions located on the outer sides of the grounding wire-use contact portion 6*a*, it is possible to use the same resin parts 30 and 31 irrespective of the number of the shielded cores 4, so that the common use of the resin parts 30 and 31 can be realized.

In addition, in this fourth embodiment, when the pair of resin members 30 and 31 compress the grounding wire-use contact portion 6*a* of the aluminum foil shield member 6 and the grounding wire 13 by their flat surfaces 40 and 41, and the vibrational energy of ultrasonic vibration is applied thereto in this compressed state, as shown in FIG. 22, the insulating outer jackets 13*b* and 7 are melted and scattered while the conductor 13*a* of the grounding wire 13 is expanded by the compressive force, so that the conductor 13*a* of the grounding wire 13 in the expanded state is connected to the aluminum foil shield member 6. Accordingly, numerous points of contact are obtained between the grounding wire 13 and the aluminum foil shield member 6, thereby improving the reliability of electric characteristics in connection.

Fifth Embodiment

Figure 24:
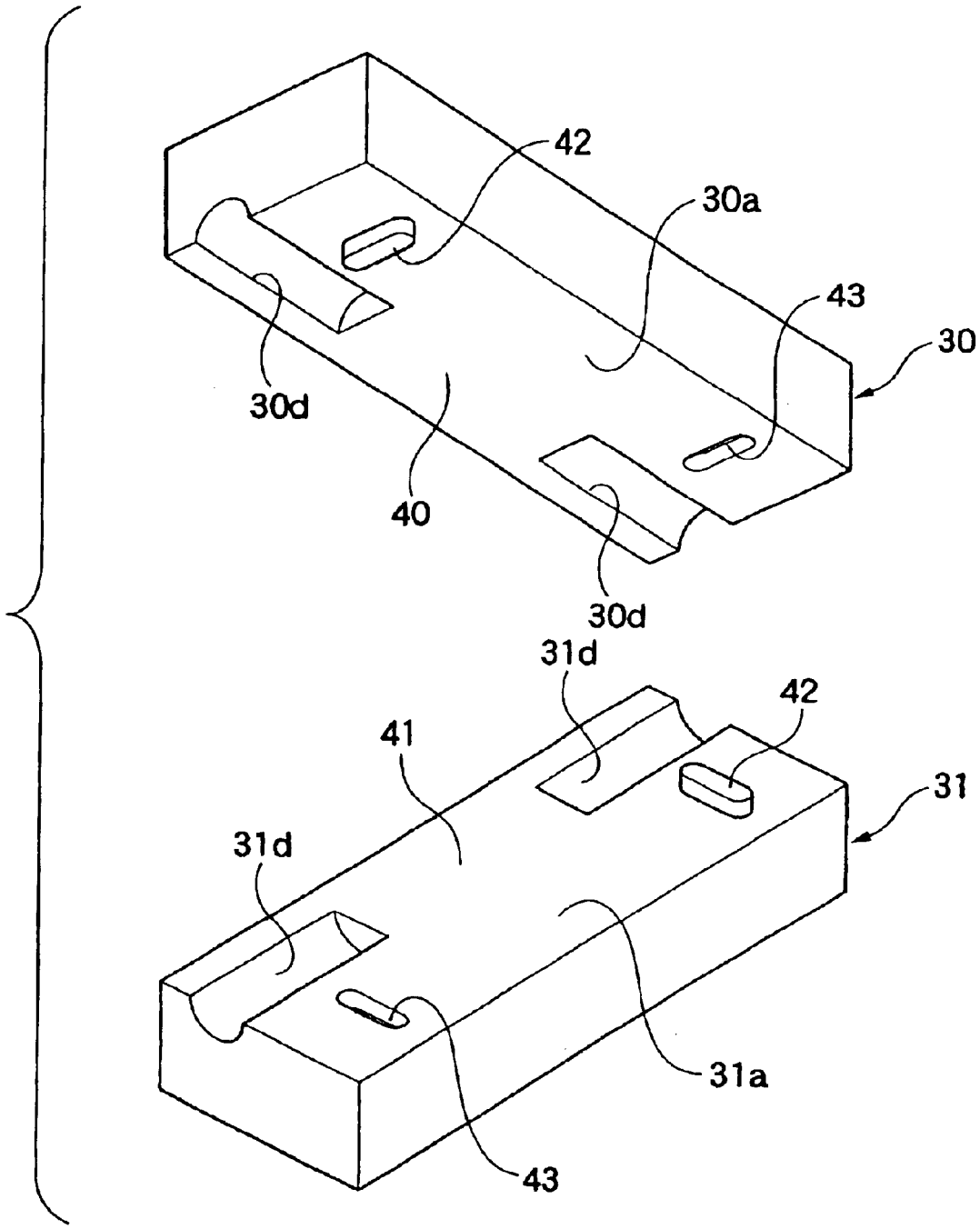
FIG. 24 is a perspective view of the pair of resin members in accordance with a fifth embodiment.
Figure 25:
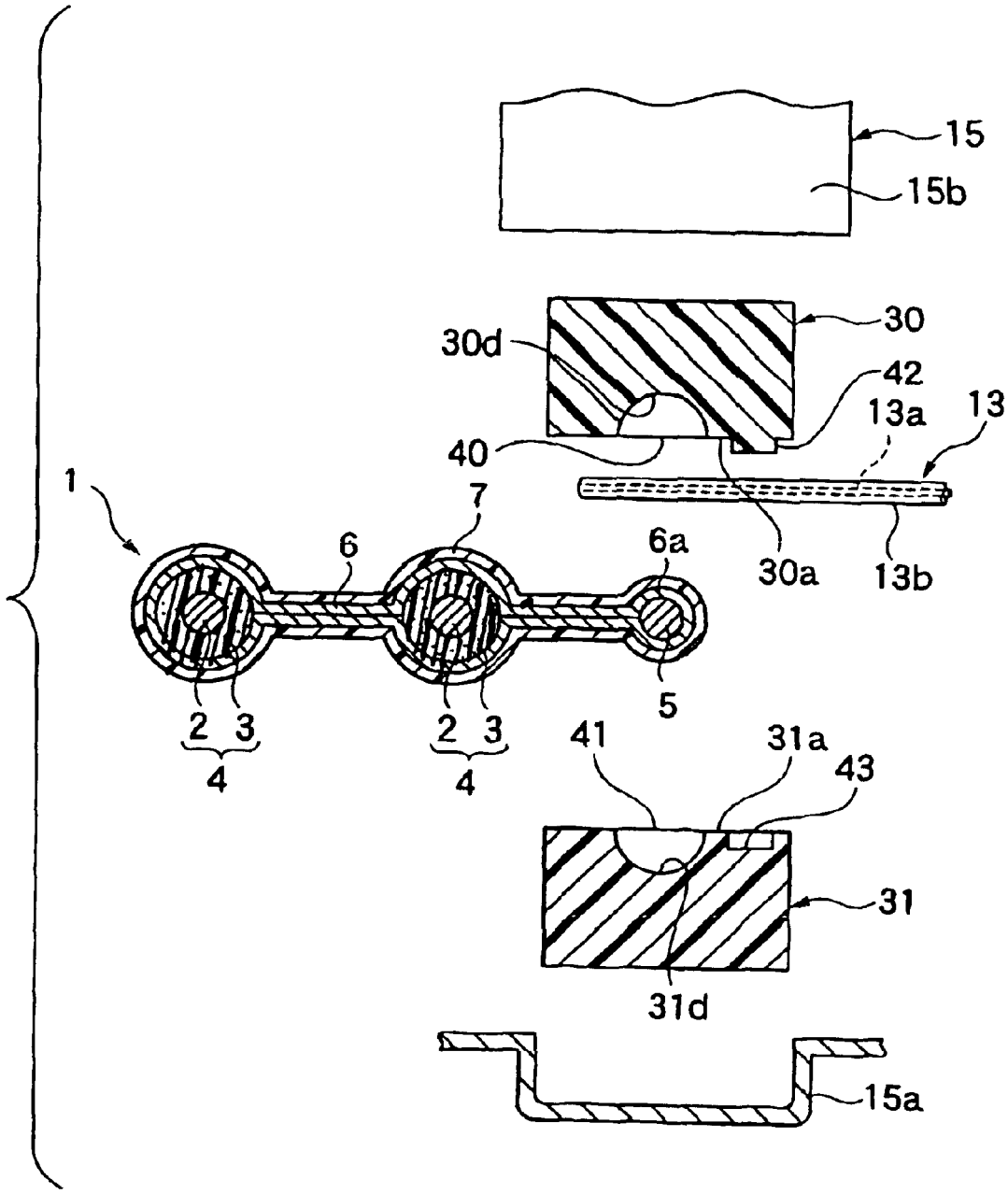
FIG. 25 is a diagram illustrating the relationship of layout of the respective members at the time of ultrasonic vibration in accordance with a fifth embodiment.
Figure 26:
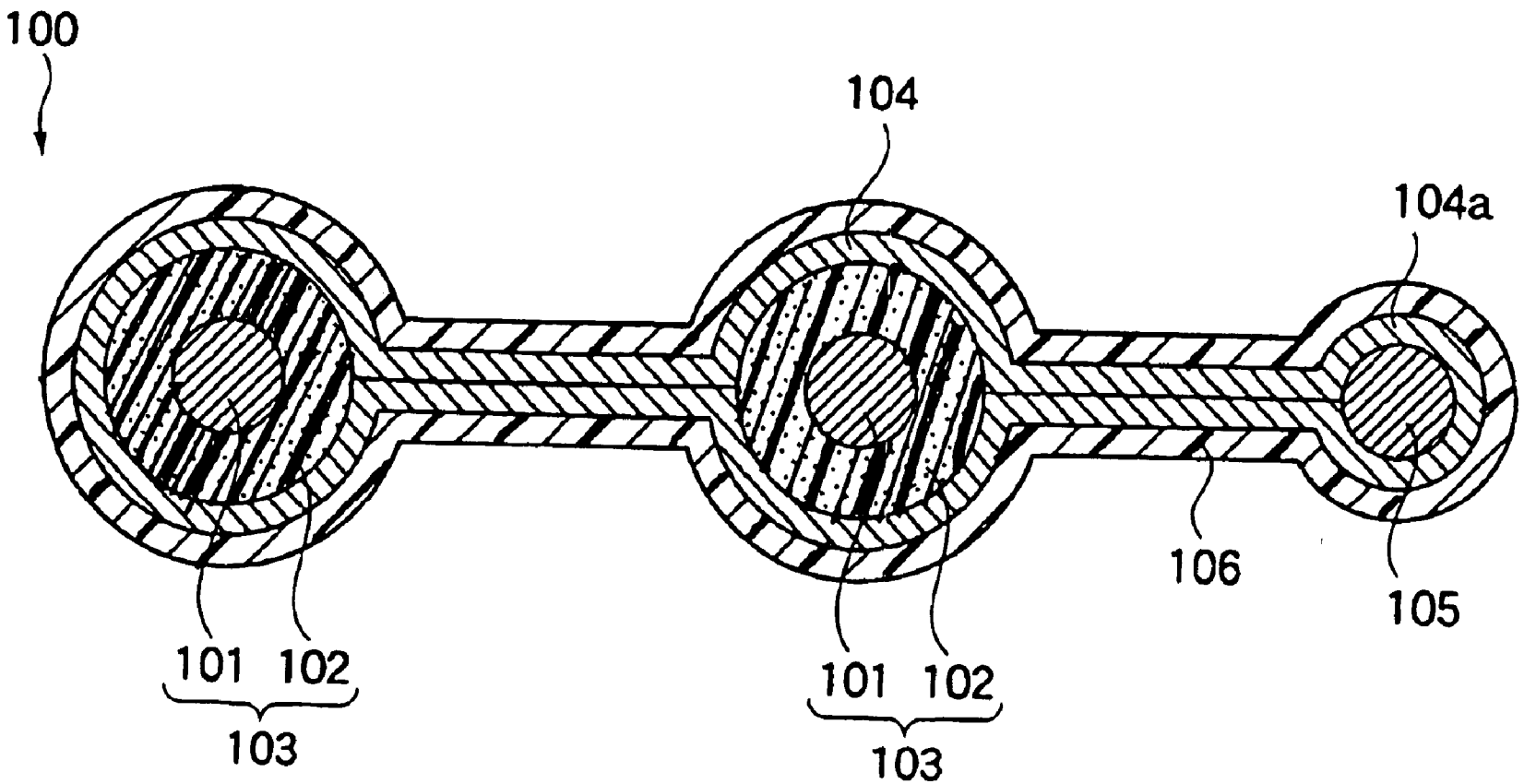
FIG. 26 PRIOR ART
FIG. 26 is a cross-sectional view of the flat shielded cable.
Figure 27:
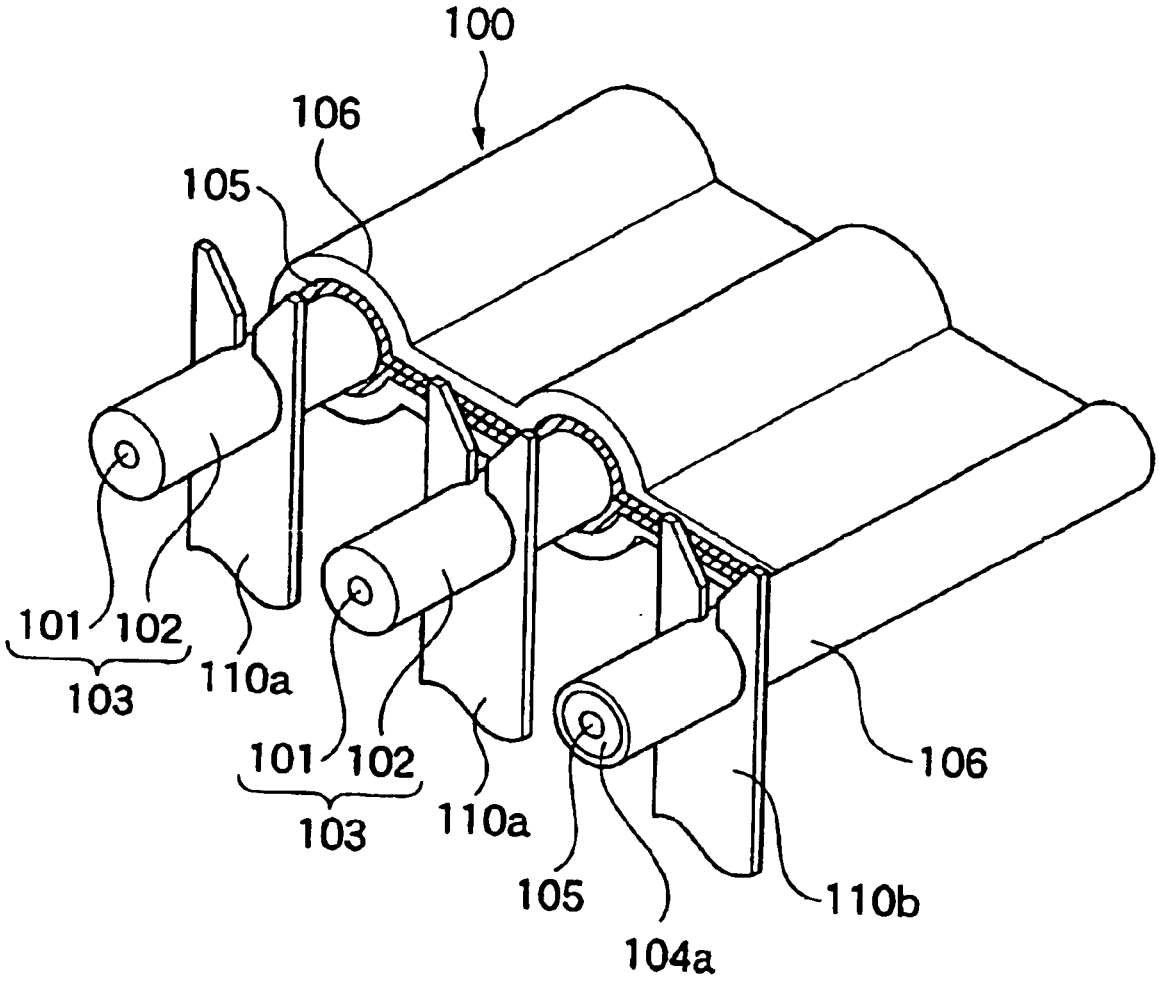
FIG. 27 PRIOR ART
FIG. 27 is a perspective view illustrating conventional shield processing of the flat shielded cable.

FIGS. 24 and 25 illustrate a fifth embodiment of the invention. FIG. 24 is a perspective view of the pair of resin members 30 and 31, and FIG. 25 is a diagram illustrating the relationship of layout of the respective members at the time of ultrasonic vibration.

Since this fifth embodiment has a construction substantially similar to that of the above-described fourth embodiment, identical constituent portions will be denoted by the same reference numerals in the drawings, a description thereof will be omitted, and only different constituent portions will be described. Namely, in the joining surface 30*a* of the upper resin member 30, a positional-offset preventing projection 42 and a positional-offset preventing grove 43 are provided at portions with which the flat shielded cable 1 is not brought into close contact when the flat shielded cable 1 is clamped. Meanwhile, in the joining surface 31*a* of the lower resin member 31, a positional-offset preventing groove 43 and a positional-offset preventing projection 42 are provided at positions respectively corresponding to the positional-offset preventing projection 42 and the positional-offset preventing grove 43 of the upper resin member 30. The engaging projections 42 and the engaging grooves 43 are substantially elliptical in shape and, to be more precise, they are so shaped that mutually opposing semicircular arcs are connected by straight lines.

In this fifth embodiment as well, in the same way as in the above-described fourth embodiment, it is unnecessary to effect the operation itself of removing the jacket of the flat shielded cable 1 or the like. Moreover, the shield processing can be effected in a simple process in which assembly is performed in the order of the lower resin member 11, the flat shielded cable 1, one end side of the grounding wire 13, and the upper resin member 30, followed by ultrasonic vibration. In addition, automation is made possible since the number of steps is thus small and intricate manual operation is not involved.

In addition, in this fifth embodiment as well, in the same way as in the above-described fourth embodiment, since the pair of resin members 30 and 31 do not contact the insulating outer jacket 7 on the outer side of each shielded core 4, and the insulating outer jacket 7 in that portion is not melted by the ultrasonic vibration, the insulating outer jacket 7 on the outer side of each shielded core 4 is not broken or cut by the ultrasonic vibration, so that it is possible to prevent a decline in the cable strength. In addition, since only the portions located on the outer sides of the grounding wire-use contact portion 6*a* are clamped by the pair of resin members 30 and 31, it is possible to use the same resin parts 30 and 31 irrespective of the number of the shielded cores 4, so that the common use of the resin parts 30 and 31 can be realized.

In addition, when the flat shielded cable 1 is clamped by the pair of resin members 30 and 31, the respective positional-offset preventing projections 42 and positional-offset preventing grooves 43 of the pair of resin members 30 and 31 are engaged, and ultrasonic vibration is effected in this engaged state. Accordingly, since the pair of resin members 30 and 31 do not undergo positional offset by the ultrasonic vibration, it is possible to prevent the occurrence of cuts, breakage, or the like in the insulating outer jackets 7 and 13*b* of the flat shielded cable 1 and the grounding wire 13 owing to the positional offset of the pair of resin members 30 and 31. Further, it is possible to prevent a situation in which the occurrence of the positional offset of the pair of resin members 30 and 31 makes it difficult to obtain a contact between the grounding wire-use contact portion 6*a* of the flat shielded cable 1 and the conductor 13*a* of the grounding wire 13, and it is therefore possible to obtain satisfactory electrical performance.

In addition, in this fifth embodiment, since the positional-offset preventing projections 42 and positional-offset preventing grooves 43 are so shaped that mutually opposing semicircular arcs are connected by straight lines, welding can be effected while preventing the positional offset between the pair of resin members 30 and 31 in the vertical and horizontal directions.

In addition, in the fourth and fifth embodiments, grounding wire-accommodating grooves as in the above-described third embodiment may be provided. Namely, in the respective joining surfaces 30*a* and 31*a* of the pair of resin members 30 and 31 on the exit side of the grounding wire 13, grounding wire-accommodating grooves may be respectively provided whereby a hole whose diameter is larger than that of the grounding wire 13 is formed with the respective joining surfaces 30*a* and 31*a* abutting against each other. Further, the inner peripheral surfaces of these grounding wire-accommodating grooves may be formed as tapered surfaces such that the diameter of each of these inner peripheral surfaces on the exit side of the grounding wire 13 is gradually enlarged from the inner side toward the outer side. If these arrangements are provided, since the transmission of the vibrational energy by the ultrasonic vibration is suppressed on the exit side of the grounding wire 13 by the grounding wire-accommodating grooves and their tapered surfaces, it is possible to prevent the dielectric breakdown of the grounding wire 13, thereby improving the insulation performance of the grounding wire 13. In addition, even if the grounding wire 13 is bent after ultrasonic welding, the breakage of the insulating outer jacket 13*b* due to the edge effect is suppressed by the tapered surfaces on the exit side of the grounding wire 13, which also makes it possible to prevent the breakage of the insulating outer jacket of the grounding wire 13 and improves the strength of the grounding wire 13.

In addition, in the above-described first to fifth embodiments, since the drain wire 5 is disposed inside the grounding wire-use contact portion 6*a* of the aluminum foil shield member 6, the conductor 13*a* of the grounding wire 13 is brought into contact with the drain wire 5 as well, the shield processing is made reliable.

In addition, in the above-described first to fifth embodiments, if a low-melting metal-plated wire such as a tinned wire is used as the conductor 13*a* of the grounding wire 13, since part of the low-melting metal-plated wire is melted by the vibrational energy and is brought into contact with the aluminum foil shield member 6, the reliability of the contact portions of the aluminum foil shield member 6 of the flat shielded cable 1 and the conductor 13*a* of the grounding wire 13 improves.

In addition, according to the above-described first to fifth embodiments, when the grounding wire 13 is interposed between the resin member 10 and the flat shielded cable 1, the grounding wire 13 is disposed in a state in which the insulating outer jacket 13*b* is not peeled off, but the grounding wire 13 whose insulating outer jacket 13*b* has been peeled off may be disposed.

In addition, according to the above-described first to fifth embodiments, although the shield cover member is formed by the aluminum foil shield member 6, the shield cover member may be formed by a conductive metal foil other than the aluminum foil, or may be formed by a conductive braided wire.

It should be noted that, according to the above-described first to fifth embodiments, although the flat shielded cable 1 is provided with the drain wire 5, the flat shielded cable 1 may not be provided with the drain wire 5. Nevertheless, if the flat shielded cable 1 is provided with the drain wire 5 as in the above-described first to fifth embodiments, there is an advantage in that the reliability of the connected portion improves as the conductor 13*a* of the grounding wire 13 and the drain wire 5 are brought into contact with each other by ultrasonic welding as described above. Additionally, since the shield processing is possible by making use of this drain wire 5 alone, there is an advantage in that variations of the shielding measure increase by that portion.

It should be noted that, according to the above-described first to fifth embodiments, although a description has been given of the flat shielded cable 1 having two shielded cores 4, it goes without saying that the invention is similarly applicable to a flat shielded cable having three or more shielded cores 4.

Sixth Embodiment

Figure 28:
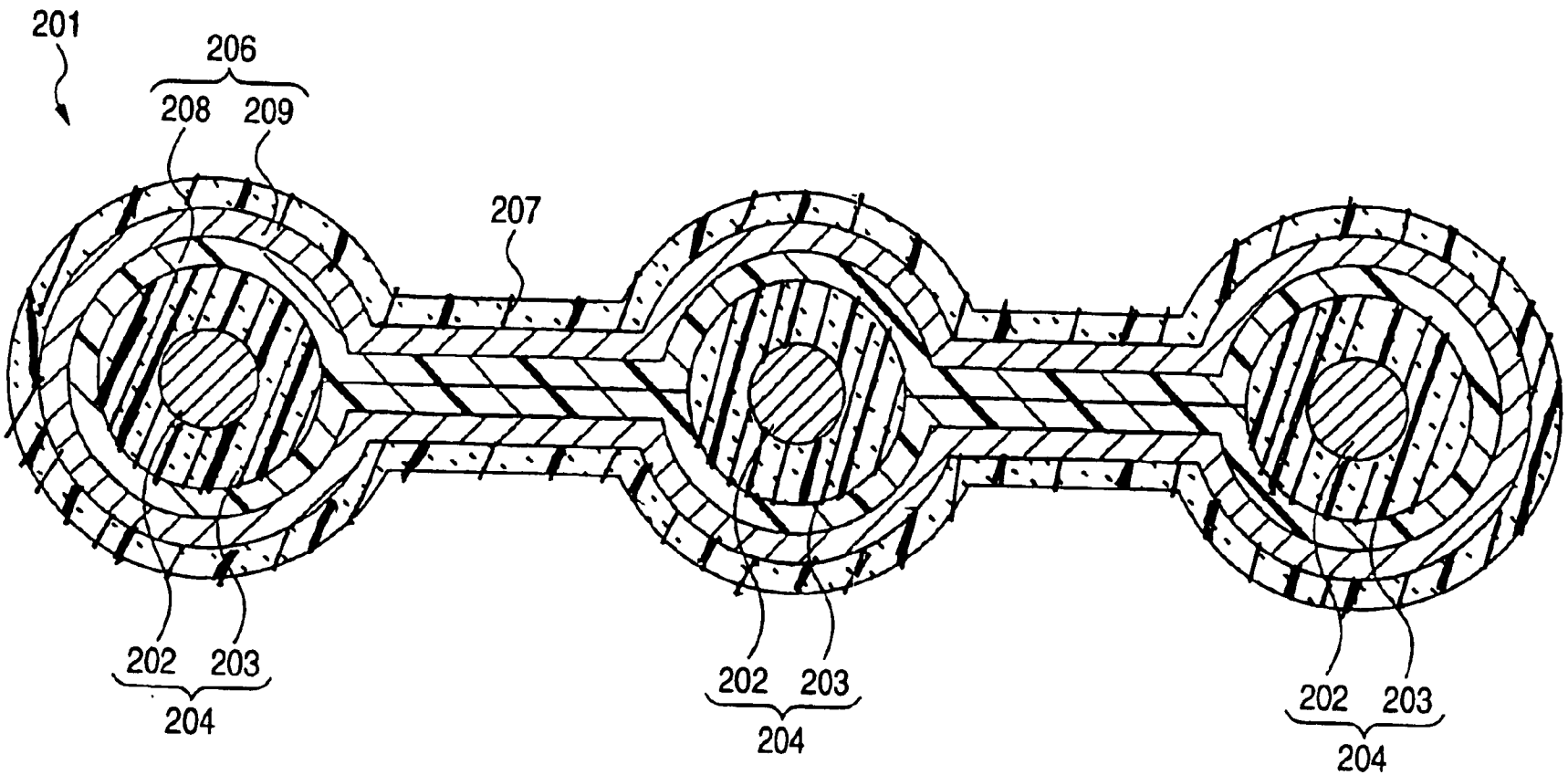
FIG. 28 shows a sixth embodiment of the invention, and is a cross-sectional view of a flat shielded cable.
Figure 29:
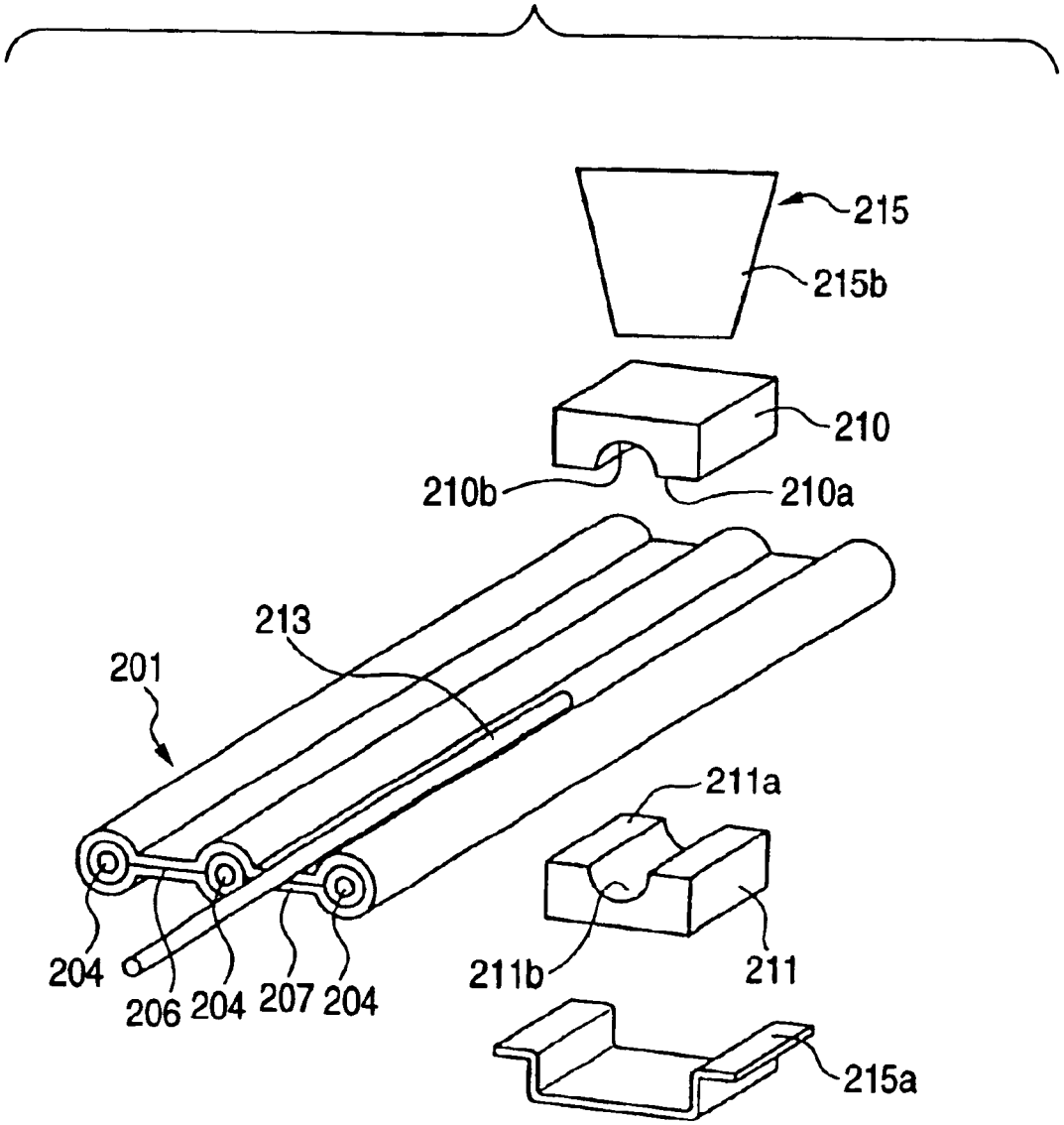
FIG. 29 shows the sixth embodiment of the invention, and is a perspective view showing the arrangement of relevant members at the time of applying ultrasonic vibrations.
Figure 30:
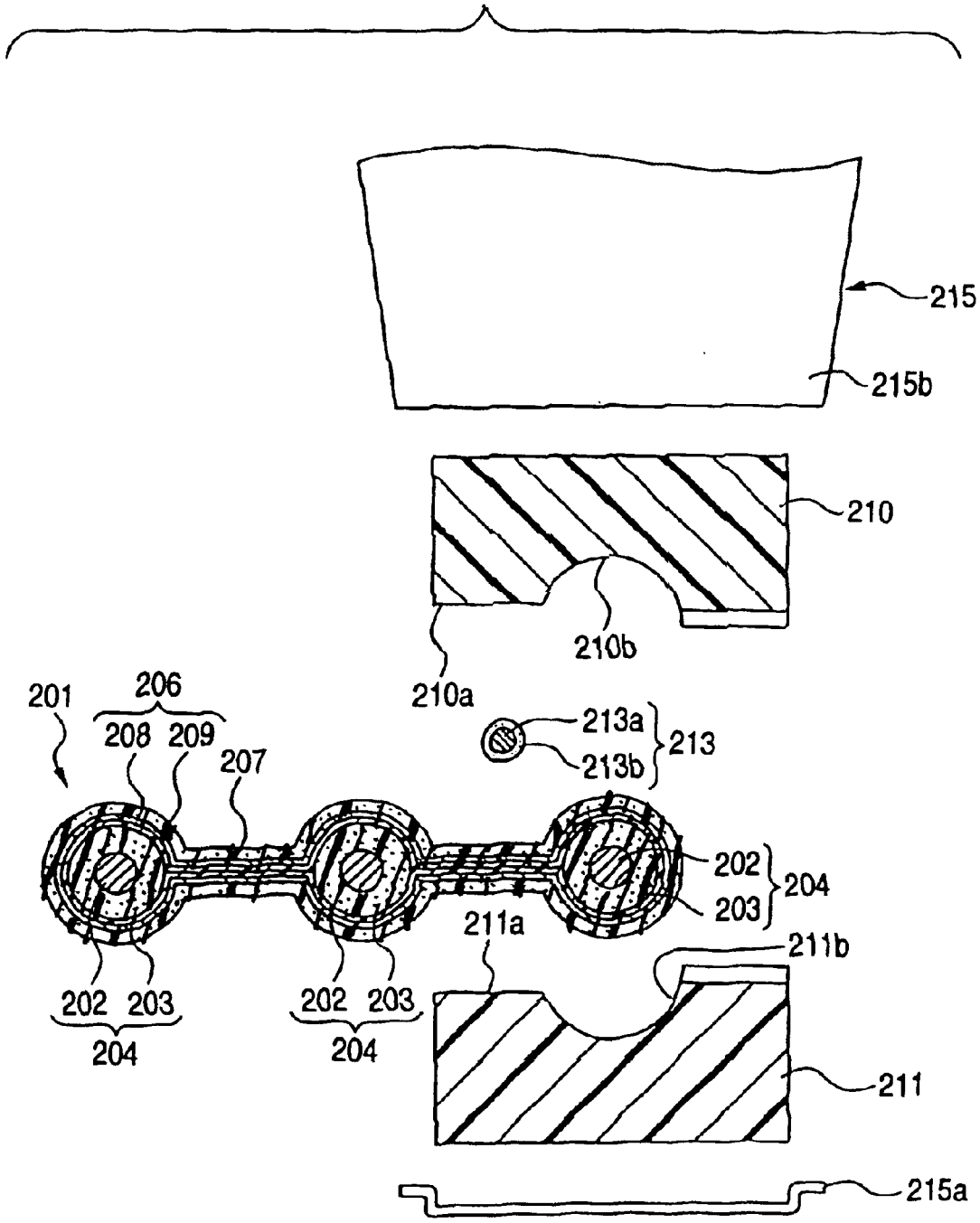
FIG. 30 shows the sixth embodiment of the invention, and is a cross-sectional view showing the arrangement of the relevant members at the time of applying the ultrasonic vibrations.
Figure 31:
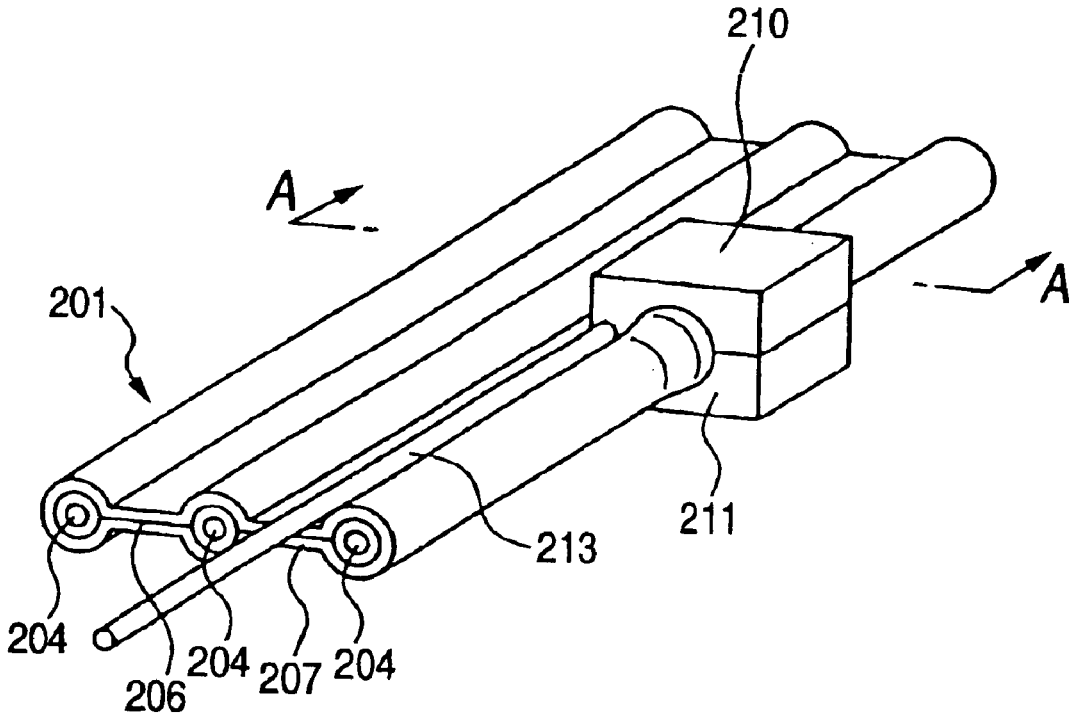
FIG. 31 shows the sixth embodiment of the invention, and is a perspective view of the flat shielded cable having a shield-processing structure formed thereon.
Figure 32:
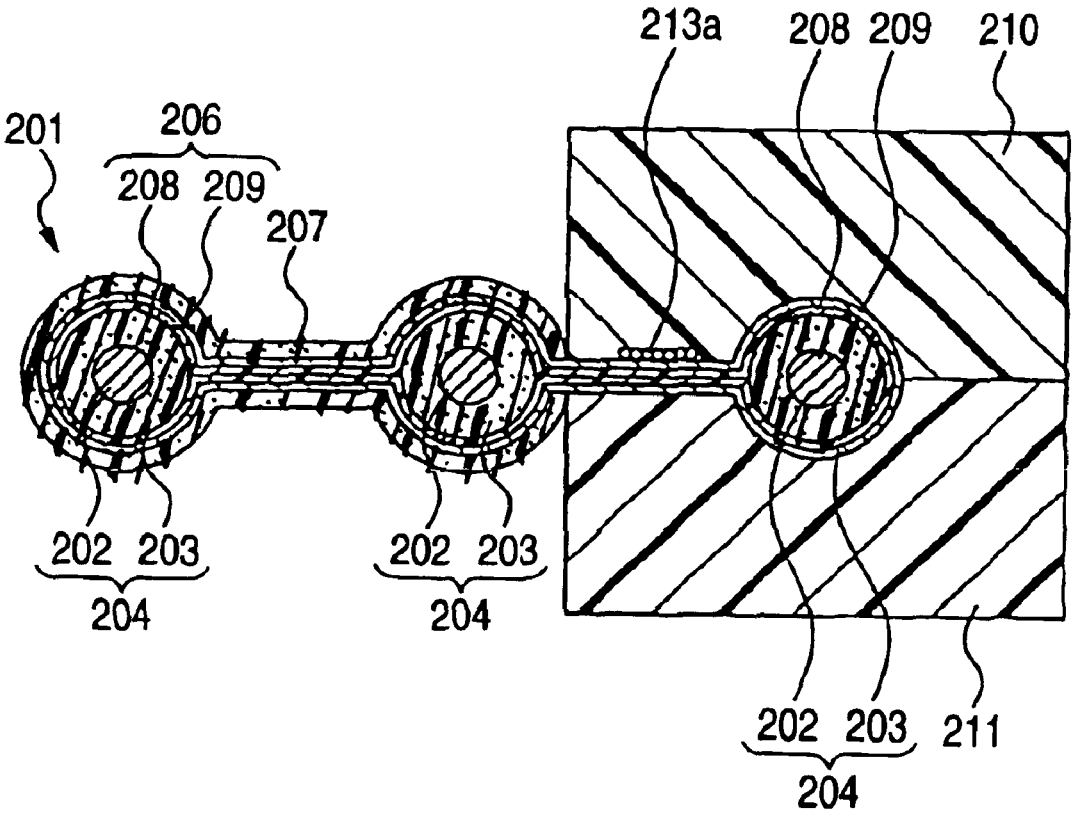
FIG. 32 shows the sixth embodiment of the invention, and is a cross-sectional view taken along the line A—A of FIG. 31.

FIGS. 28 to 32 show a sixth embodiment of the present invention, and FIG. 28 is a cross-sectional view of a flat shielded cable, FIG. 29 is a perspective view showing the arrangement of relevant members at the time of applying ultrasonic vibrations, FIG. 30 is a cross-sectional view showing the arrangement of these members at the time of applying the ultrasonic vibrations, FIG. 31 is a perspective view of the flat shielded cable having a shield-processing structure formed thereon, and FIG. 32 is a cross-sectional view taken along the line A—A of FIG. 31.

In the first embodiment of the shield-processing structure of the invention, a shielding covering member 206 of the flat shielded cable 201 is electrically connected to a conductor 213*a* of a ground wire 213, using a pair of resin members 210 and 211 and an ultrasonic horn 215.

As shown in FIG. 28, the flat shielded cable 201 comprises three parallel-arranged shielded cores 204 each having a core 202 covered with an insulating inner jacket 203, the shielding covering member 206 of an electrically-conductive nature covering outer peripheries of the three shielded cores 204, and an insulating outer jacket 207 covering an outer periphery of the shielding covering member 206.

The shielding covering member 206 has a two-layer structure, and comprises an electrically-insulative foil-reinforcing sheet 208 as an inner layer, and an electrically-conductive metal foil 209 as an outer layer, and the foil-reinforcing sheet 208 is indispensable for forming the electrically-conductive metal foil 209 into a sheet-shape. In this embodiment, the foil-reinforcing sheet 208 comprises a polyester sheet. The electrically-conductive metal foil 209 comprises an aluminum foil, a copper foil or the like. The insulating inner jacket 203 and the insulating outer jacket 207 are made of an insulative synthetic resin, and like the electrically-conductive metal foil 208, the core 202 is made of an electrically-conductive material.

As shown in FIGS. 28 and 29, the pair of resin members 210 and 211 are blocks of an identical shape, respectively, which are made of a synthetic resin, and these resin members 210 and 211 have joint surfaces 210*a* and 211*a*, respectively, which are to be joined together. Recesses 210*b* and 211*b*, substantially corresponding in cross-sectional shape to an outside portion of the flat shielded cable 201 disposed around the shielded core 204, are formed in these joint surfaces 210*a* and 211*a*, respectively. Each of the recesses 210*b* and 211*b* is in the form of a groove of a semi-circular cross-section corresponding in radius to the outside portion of the flat shielded cable disposed around the shielded core 204. The pair of resin members 210 and 211 can hold the flat shielded cable 201 therebetween in such a manner that inner surfaces of the recesses 210*b* and 211*b* are held in intimate contact with the outer surface of the cable disposed around the shielded core 204 and that those portions of the resin members. 210 and 211, disposed adjacent respectively to the recesses 210*b* and 211*b*, are held in intimate contact respectively with opposite sides (outer surfaces) of that portion of the cable lying between the adjacent shielded cores 204.

With respect to physical properties of the resin members 210 and 211, they are less liable to be fused than the insulating outer jacket 207, etc., and are made of an acrylic resin, an ABS (acrylonitrile-butadiene-styrene copolymer) resin, a PC (polycarbonate) resin, a PE (polyethylene) resin, a PEI (polyether imide) resin, a PBT (polybutylene terephthalate) resin or the like. Generally, the resin of which these resin members are made is more rigid than vinyl chloride or the like used to form the insulating outer jacket 207, etc. From the viewpoints of electrical conductivity and conducting safety, all of the above resins are required to provide practicality, and when a judgment is made from various aspects including the appearance and an insulative nature, a PEI (polyether imide) resin and a PBT (polybutylene terephthalate) resin are particularly suitable.

As shown in FIG. 30, the ground wire 213 comprises the conductor 213*a*, and an insulating sheath 213*b* covering an outer periphery of this conductor 213*a*. As shown in FIGS. 29 and. 30, the ultrasonic horn 215 comprises a lower support base 215*a* for positioning the resin member 211 located at a lower position, and an ultrasonic horn body 215*b* which is located right above this lower support base, and is supplied with ultrasonic vibrations while exerting a pressing force downwardly.

Next, the procedure of the shield-processing will be described.

As shown in FIGS. 29 and 30, the lower resin member 211 is placed on the lower support base 215*a* of the ultrasonic horn 215, and a portion of the flat shielded cable 201, disposed adjacent to one end thereof, is placed on this lower resin member. Then, the ground wire 213 is placed on the upper surface of that portion of the thus placed flat shielded cable 201, lying between the adjacent shielded cores 204, in parallel relation to the shielded cores 204. Then, the upper resin member 210 is put on the flat shielded cable from the upper side at a position where one end portion of the placed ground wire 213 is located. In this manner, part of the flat shielded cable 201 is located in the recesses 210*b* and 211*b* of the pair of resin members 210 and 211, and also the one end portion of the ground wire 213 is interposed between the upper surface of the flat shielded cable 201 and the upper resin member 210.

Then, the ultrasonic horn body 215*b* is moved downward, and when vibration is applied to the pair of resin members 210 and 211 by the ultrasonic horn 215 while exerting a compressive force between the pair of resin members 210 and 211, the insulating outer jacket 207 of the flat shielded cable 201 and the insulating sheath 213*b* of the ground wire 213 are fused and dissipated by internal heat produced by the vibration energy, so that the conductor 213*a* of the ground wire 13 and the electrically-conductive metal foil 209 of the flat shielded cable 1 are electrically contacted with each other as shown in FIG. 32.

Also, a contact portion between the joint surfaces 210*a* and 211*a* of the pair of resin members 210 and 211, a contact portion between the inner peripheral surface of the recess 210*b*, 211*b* of each of the resin members 210 and 211 and the insulating outer jacket 207 of the flat shielded cable 201, and a contact portion between the insulating sheath 213*b* of the ground wire 213 and there in member 210 are fused by the internal heat produced by the vibration energy as shown in FIG. 32. After the application of the ultrasonic vibration is finished, these fused portions are solidified, so that the pair of resin members 210 and 211, the flat shielded cable 201 and the ground wire 213 are fixed to one another.

In this shield-processing structure of the flat shielded cable 201, the compressive force due to the ultrasonic vibration and the internal heat, produced by the vibration energy, are exerted on the ground wire 213 and the flat shielded cable 201 through the pair of resin members 210 and 211, and their insulating outer jackets 207 and 213*b* are fused and dissipated, so that the conductor 213*a* of the ground wire 213 and the shielding covering member 206 are contacted with each other. In this case, the ground wire 213 presses the portion between the adjacent shielded cores 204, and the insulating inner jacket 203 is not present in this portion, and therefore the ground wire 213 presses the shielding covering member 206 with a stable pressing force, so that a stable electrically-contacted condition can be obtained between the ground wire 213 and the shielding covering member 206. And besides, since the ground wire 213 will not press the region where the shielded core 204 exists, the insulating inner jacket 203 of the shielded core 204 will not be ruptured, so that an accident of short-circuiting between the shielding covering member 206 and the core 202 is prevented.

In this embodiment, the ground wire 213 is arranged parallel to the shielded cores 204 such that the one end portion of this ground wire is set between the adjacent shielded cores 204. Therefore, the one end portion of the ground wire 213 can be easily set between the adjacent shielded cores 204 of the flat shielded cable 201. Namely, in the case where the ground wire 213 is disposed perpendicularly or obliquely to the shielded cores 204 in such a manner that one end portion of this ground wire is set between the adjacent shielded cores 204, the one end portion of the ground wire 213 can not be disposed on the flat shielded cable 201 in a stable condition, and therefore this setting is difficult. However, when the ground wire 213 is disposed parallel to the shielded cores 204, the one end portion of the ground wire 213 can be easily set on the flat shielded cable 201 in a stable condition, and therefore this setting is easy.

The shielding covering member 206 has the two-layer structure, and comprises the electrically-insulative foil-reinforcing sheet 208 as the inner layer, and the electrically-conductive metal foil 209 as the outer layer, and in addition to the insulating inner jacket 203, the foil-reinforcing sheet 208 is interposed between the electrically-conductive metal foil 209 of the shielding covering member 206 and the core 202 of the shielded core 204, and therefore the short-circuiting between the shielding covering member 206 and the core 202 can be more positively prevented.

In the ultrasonic welding, when only the insulating outer jacket 207 is fused and dissipated on the part of the flat shielded cable 201, the area of contact between the conductor 213*a* of the ground wire 213 and the electrically-conductive metal foil 209 of the flat shielded cable 201 can be obtained, and therefore a stable electrically-contacted condition can be obtained between this electrically-conductive metal foil and the conductor 213*a* of the ground wire 213.

The foil-reinforcing sheet 208 comprises the polyester sheet, and therefore can firmly reinforce the electrically-conductive metal foil 209 while allowing the flat shielded cable 201 to have a suitable degree of flexibility. Therefore, an installation layout of the flat shielded cable 201 can be easily achieved while enhancing the reliability of connection between the flat shielded cable 201 and the ground wire 213. When low-melting metal-plated wires are used as the conductor 213*a* of the ground wire 213, part of the low-melting metal-plated wires are fused by the vibration energy, and are brought into contact with the electrically-conductive metal foil 209, so that the reliability of the contact portion between the electrically-conductive metal foil 209 of the flat shielded cable 201 and the conductor 213*a* of the ground wire 213 is enhanced. Although the ground wire 213 is located between the resin member 210 and the flat shielded cable 201, with its outer sheath 213*b* not removed, the ground wire 213 may be located therebetween, with a predetermined portion of the outer sheath 213*b* removed.

The pair of resin members 210 and 211 contact the outside portion around the one shielded core 204, but do not contact the outside portions disposed respectively around the other two shielded cores 204, and therefore the insulating outer jacket 207 will not be fused at these portions by the ultrasonic vibration. Therefore, all of those portions of the insulating outer jacket 207, disposed respectively around the three shielded cores 204, will not be ruptured or cut by the ultrasonic vibration, and therefore the strength of the cable is prevented from being reduced. And besides, only the outside portion around the one shielded core 204 is held by the pair of resin members 210 and 211, and therefore the same resin members 210 and 211 can be used regardless of the number of the shielded cores 204, and therefore the resin members 210 and 211 for common use can be used.

The pair of resin members 210 and 211 may be so sized and shaped as to hold the whole of the outside portion of the cable covering the three shielded cores 204. In other case, the two resin members may be so sized and shaped as to hold only that portion of the cable lying between any two adjacent shielded cores 204. With such a construction, the pressing force hardly acts on any shielded core 204 during the ultrasonic welding, and therefore a short-circuiting accident due to the rupture of the insulating inner jacket 203 can be positively prevented.

In the above embodiment, although the flat shielded cable 201 has the three shielded cores 204, the present invention can, of course, be applied to a cable having two or more than three shielded cores.

As described above, in the invention, the compressive force due to the ultrasonic vibration and the internal heat, produced by the vibration energy, are exerted on the ground wire and the flat shielded cable through the pair of resin members, and at least the insulating outer jacket is fused and dissipated, so that the conductor of the ground wire and the shielding covering member are contacted with each other. In this case, the ground wire presses the portion between the adjacent shielded cores, and the insulating inner jacket is not present in this portion, and therefore the ground wire presses the shielding covering member with the stable pressing force. Therefore, the stable electrically-contacted condition can be obtained between the ground wire and the shielding covering member, and besides since the ground wire will not press the regions where the shielded cores exist, the insulating inner jacket of the shielded core will not be ruptured, so that an accident of short-circuiting between the shielding covering member and the core is positively prevented.

In the invention, the ground wire is arranged parallel to the shielded cores such that the one end portion of the ground wire is set between the adjacent shielded cores. Therefore, the one end portion of the ground wire can be easily set between the adjacent shielded cores of the flat shielded cable.

In the invention, the shielding covering member has the two-layer structure, and comprises the electrically-insulative foil-reinforcing sheet as the inner layer, and the electrically-conductive metal foil as the outer layer, and in addition to the insulating inner jacket, the foil-reinforcing sheet is interposed between the electrically-conductive metal foil of the shielding covering member and the core of the shielded core. Therefore, the short-circuiting between the shielding covering member and the core can be more positively prevented. And besides, in the ultrasonic welding, when only the insulating outer jacket is fused and dissipated on the part of the flat shielded cable, the area of contact between the core of the ground wire and the electrically-conductive metal foil of the flat shielded cable can be obtained, and therefore the stable electrically-contacted condition can be obtained between this electrically-conductive metal foil and the core of the ground wire.

In the invention, the foil-reinforcing sheet is a polyester sheet, and therefore the electrically-conductive metal foil is firmly reinforced while allowing the flat shielded cable to have a suitable degree of flexibility. Therefore, an installation layout of the flat shielded cable can be easily achieved while enhancing the reliability of connection between the flat shielded cable and the ground wire.

Seventh Embodiment

The seventh embodiment is different from the sixth embodiment in the mounting direction of the ground wire. In the sixth embodiment, the ground wire 213 is disposed in parallel to the shielded core 204. On the other hand, in the seventh embodiment, the ground wire 213 is disposed so as to cross to the shielded core 204. The seventh embodiment will be described in detail with particular emphasis on the difference.

Figure 33:
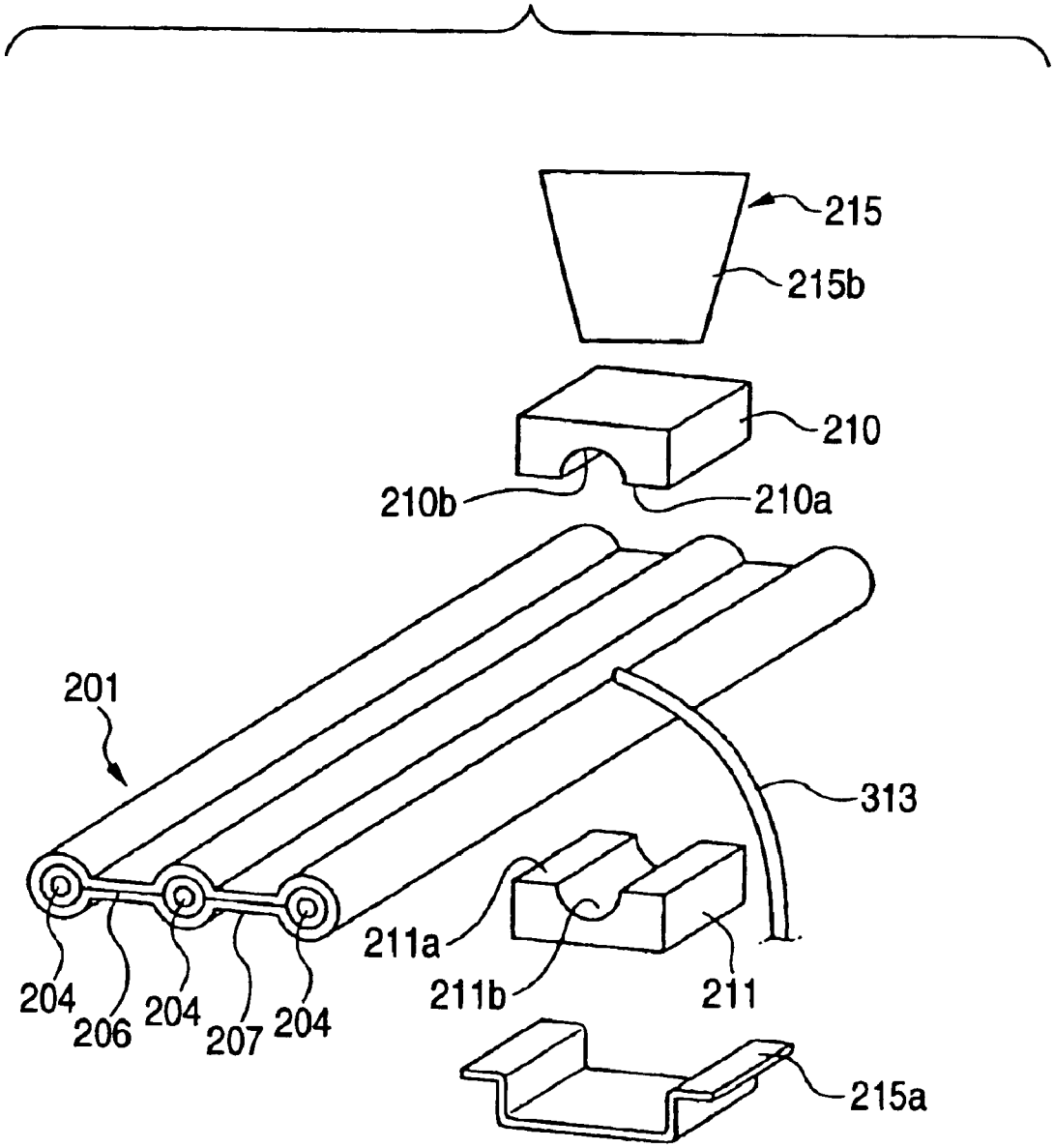
FIG. 33 shows a seventh embodiment of the invention, and is a perspective view showing the arrangement of relevant members at the time of applying ultrasonic vibrations.
Figure 34:
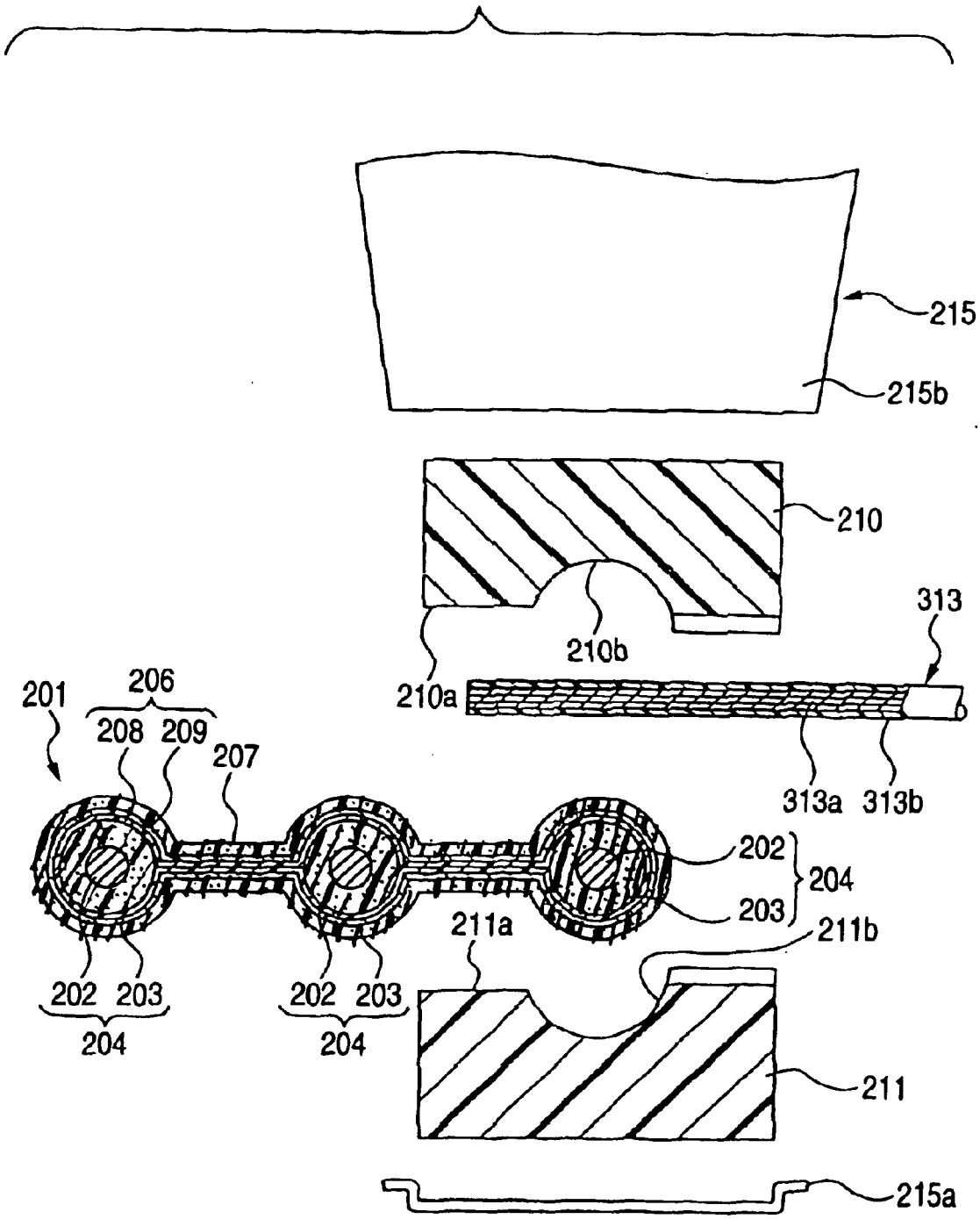
FIG. 34 shows the seventh embodiment of the invention, and is a cross-sectional view showing the arrangement of the relevant members at the time of applying the ultrasonic vibrations.
Figure 35:
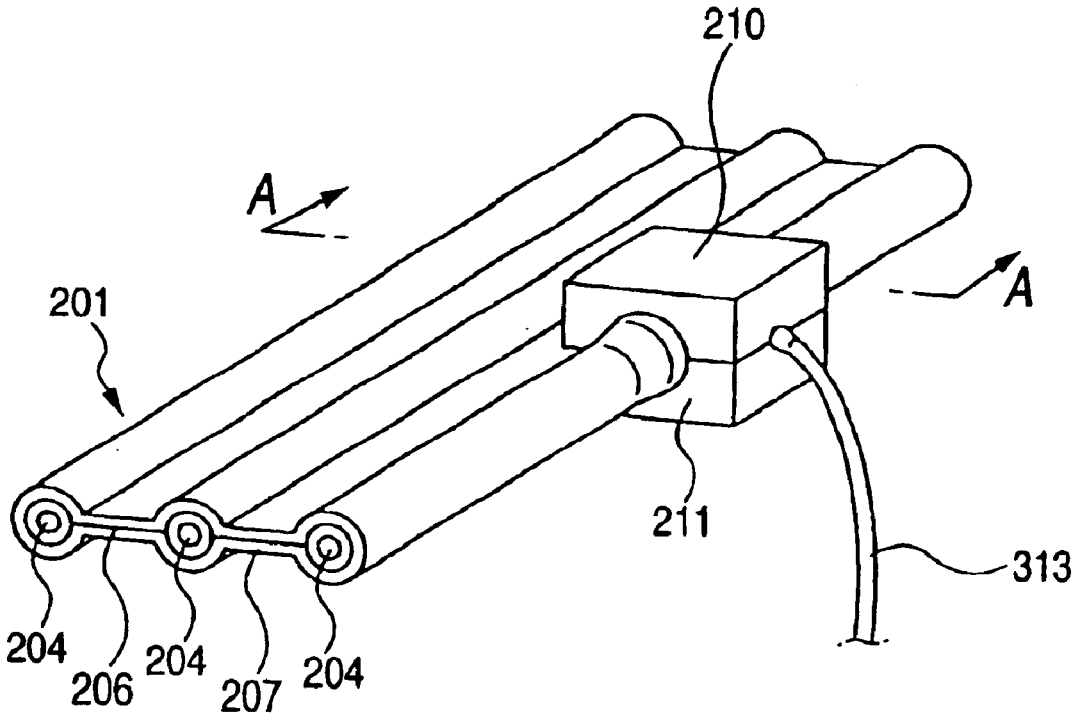
FIG. 35 shows the seventh embodiment of the invention, and is a perspective view of the flat shielded cable having a shield-processing structure formed thereon.
Figure 36:
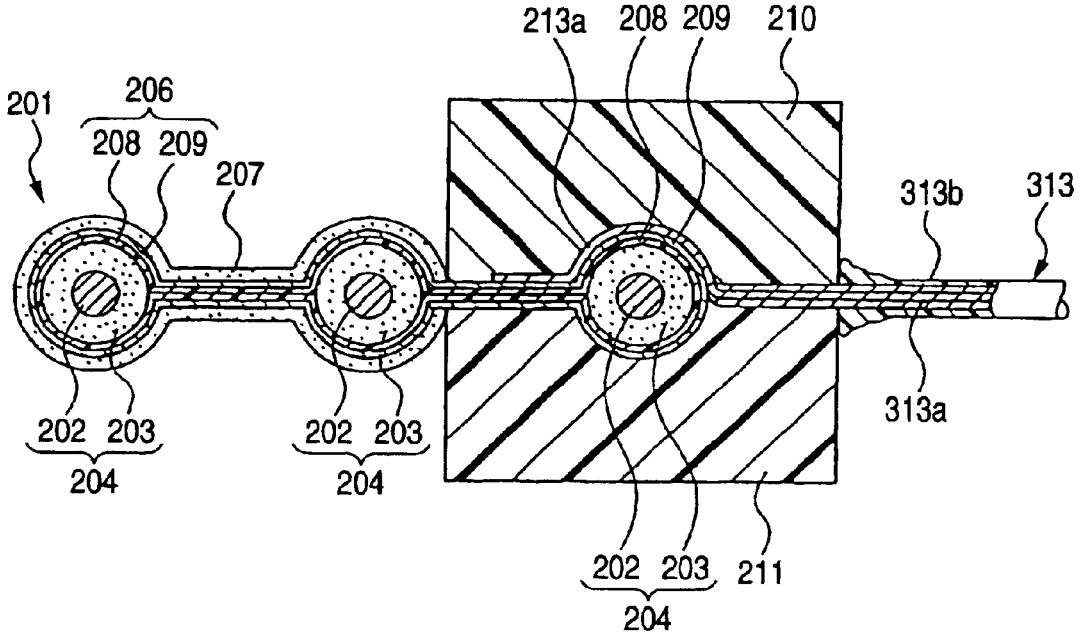
FIG. 36 shows the seventh embodiment of the invention, and is a cross-sectional view taken along the line A—A of FIG. 35.

As shown in FIGS. 33 and 34, the lower resin member 211 is placed on the lower support base 215*a* of the ultrasonic horn 215, and a portion of the flat shielded cable 201, disposed adjacent to one end thereof, is placed on this lower resin member. The flat cable 313 is put on the flat shielded cable 201 and further the resin member 210 is put thereon to cover it. Accordingly, a part of the flat shield wire 201 is disposed between the recesses 210*b* and 211*b* of the pair of resin member 210 and 211, and one end of the ground wire 313 is interposed between the upper portion of the flat shield cable 1 and the upper resin member 211.

In this shield-processing structure of the flat shielded cable 201 according to the seventh embodiment, the flat shielded cable 201 is located between the pair of resin members 210 and 211, and the one end portion of the ground wire 313 is interposed between the upper surface of the flat shielded cable 1 and the upper resin member 210. Then, when ultrasonic vibration is applied between the pair of resin members 210 and 211, the insulating outer jackets 313*b* and 207 are fused and dissipated by the internal heat produced by the vibration energy, so that the conductor 313*a* of the ground wire 313 and the electrically-conductive metal foil 209 are contacted with each other. Therefore, the shield-processing structure can be formed without the use of a drain wire as employed the conventional example. Therefore, the number of the component parts can be reduced, and the lightweight design can be achieved. And besides, in the ultrasonic welding, when only the insulating outer jacket 207 is fused and dissipated on the part of the flat shielded cable 201, the area of contact between the conductor 313*a* of the ground wire 313 and the electrically-conductive metal foil 209 of the flat shielded cable 201 can be obtained, and therefore the stable electrically-contacted condition can be obtained.

There can be formed the flat shielded cable 201 in which the number of shielded cores 204 is larger by one than that of the conventional flat shielded cable with the same volume. Namely, the conventional flat shielded cable 100 has two shielded cores 104 and one drain wire 105, while the flat shielded cable 1 of this embodiment, though having the same volume, has three shielded cores 4.

According to the present invention, it is unnecessary to effect the operation of the jacket removal itself. Moreover, the shield processing can be effected in a simple process in which assembly is performed in the order of one resin member, the flat shielded cable, one end side of the grounding wire, and the other resin member, followed by ultrasonic vibration. In addition, automation is made possible since the number of steps is thus small and intricate manual operation is not involved.

According to the present invention, automation is made possible since the number of steps is thus small and intricate manual operation is not involved. In addition, since the insulating outer jacket on the outer side of each shielded core is not broken or cut by the ultrasonic vibration, it is possible to prevent a decline in the cable strength. Further, since the pair of resin members do not clamp the portions located on the outer sides of the shielded cores but clamp only the portions located on the outer sides of the grounding wire-use contact portion, it is possible to use the same resin parts irrespective of the number of the shielded cores, so that the common use of resin parts can be realized.

According to the present invention, the grounding wire is brought into contact with the drain wire as well, so that shield processing is made reliable.

According to the present invention, when the grounding wire-use contact portion of the shield cover member and the grounding wire are compressed by the flat surfaces of the pair of resin members, and the vibrational energy of ultrasonic vibration is applied thereto in this compressed state, at least the insulating outer jacket is melted and scattered while the conductor is expanded by the compressive force, so that the conductor in the expanded state is connected to the shield cover member. Accordingly, numerous points of contact are obtained between the grounding wire and the shield cover member, thereby improving the reliability of electric characteristics in connection.

According to the present invention, the compressive force applied to the insulating outer jacket by the pair of resin members is weak in the vicinities of exits of the shielded cores from the pair of resin members by virtue of the tapered surfaces, and the transmission of the vibrational energy by the ultrasonic vibration is suppressed. Therefore, it is possible to prevent the dielectric breakdown of the shielded cores, and the insulation performance of the flat shielded cable and the strength of the flat shielded cable improve. In addition, after ultrasonic welding, the breakage of the insulating outer jacket due to the edge effect is suppressed by the tapered surfaces at the exits of the shielded cores from the pair of resin members, so that the breakage of the insulating outer jacket of the shielded cores can be prevented. This also improves the insulation performance of the flat shielded cable and the strength of the flat shielded cable.

According to the present invention, the transmission of the vibrational energy by the ultrasonic vibration is suppressed in the vicinity of an exit of the grounding wire from the pair of resin members by virtue of the grounding wire-accommodating grooves and their tapered surfaces. Hence, it is possible to prevent the dielectric breakdown of the grounding wire, and the insulation performance of grounding improves. In addition, after ultrasonic welding, the breakage of the insulating outer jacket due to the edge effect is suppressed by the tapered surfaces in the vicinity of the exit of the grounding wire from the pair of resin members. This also makes it possible to prevent the breakage of the insulating outer jacket of the grounding wire, and the strength of the grounding wire improves.

What is claimed is:

1. A structure for processing a flat shielded cable comprising:

the flat shielded cable including, a plurity of shielded cores, each including a core covered with an insulating inner jacket, a conductive shield cover member, which covers outer peripheries of the plurality of shielded cores, and has a grounding wire-use contact portion, and an insulating outer jacket for covering an outer periphery of the shielded cover member;

a ground wire;

a pair of resin members, each resin member including a joining surface and at least one recess, said recess being recessed from one of said joining surface, in an initial state, wherein in a state when the joining surfaces of the pair of resin members are abutted against each other, the recesses from a hole substantially corresponding to an outer shape of a part of the flat shielded cable; and an ultrasonic generating ultrasonic vibration, wherein the ultrasonic vibration generated by the ultrasonic generator is applied to at least one of the pair of resin members which clamps and compress at least a part of the flat shield cable in a state that the ground wire is interposed between the flat shielded cable and one of the resin members, wherein so that at least the insulating outer jacket is melted and scattered and a contact portion connecting a conductor of the ground wire and the grounding wire-use contact portion is formed;

wherein in the respective joining surfaces of the pair of resin members, portions where both the grounding wire-use contact portion and the grounding wire are disposed are formed as flat surfaces for pressing the ground wire-use contact portion and the grounding wire with the respective joining surfaces abutting each other.

2. The structure according to claim 1, wherein the plurality of shielded cores are arranged side by side.

3. The structure according to claim 1, wherein the hole formed by the recesses substantially corresponds to outer shape of the shielded cores.

4. The structure according to claim 1, wherein, in a state when the pair of resin members clamp the flat shielded cable, the pair of resin members do not contact a portion of the flat shielded cable located on an outer side of each of the shielded cores; and wherein the pair of resin members contact a portion of the shielded cable located on an outer side of the grounding wire-use contact portion.

5. The structure according to claim 1, wherein a drain wire is disposed inside the grounding wire-use contact portion.

6. The structure according to claim 1, wherein inner peripheral surfaces of the recesses of the pair of resin members are formed as tapered surfaces such that the diameter of each of the inner peripheral surfaces on an exit side of the flat shielded cable is gradually enlarged from an inner side toward an outer side.

7. The structure according to claim 1, wherein in the respective joining surfaces of the pair of resin members on an exit side of the grounding wire, grounding wire-accommodating grooves are respectively provided;

wherein a hole having a diameter of the grounding wire is formed with the joining surfaces abutting against each other, wherein inner peripheral surfaces of the grounding wire-accommodating grooves are formed as tapered surfaces; and wherein a diameter of each the inner peripheral surfaces on an exit side of the grounding wire is gradually enlarged from an inner side toward an outer side.

8. The structure according to claim 1, further comprising:

a positional-offset preventing projection formed on one of the pair of resin members; and a positional-offset preventing groove formed on another of the pair of resin members;

wherein the positional-offset preventing projection and positional-offset preventing groove are formed at portions of the joining surfaces of the pair of resin members with which the flat shielded cable does not contact in a state when the flat shielded cable is clamped;

wherein a position of the positional-offset preventing projection corresponds to an opposing position of the positional-offset preventing groove; and wherein the positional-offset preventing projection engages the positional-offset preventing groove in a state when the flat shielded cable is clamped by the pair of resin members.

9. The structure according to claim 1, wherein the ground wire is arranged substantially parallel to the shielded cores such that one end portion of the ground wire is interposed between the adjacent shielded cores.

10. The structure according to claim 1, wherein the shielding covering member has a two-layer structure, and comprises an electrically-insulative foil-reinforcing sheet as an inner layer, and an electrically-conductive metal foil as an outer layer.

11. The structure according to claim 11, wherein the foil-reinforcing sheet is a polyester sheet.

12. A method of processing a flat shielded cable which includes a plurality of shielded cores, each including a core covered with an insulating inner jacket, a conductive shield cover member which covers outer peripheries of the plurality of shielded cores and has a grounding wire-use contact portion, and an insulating outer jacket for covering an outer periphery of the shielded cover member, and a ground wire by a pair of resin members, the method comprising the steps of:

clamping the flat shielded cable between the pair of resin members; wherein each of the pair of resin members includes a joining surfaces and at least one recess, in an initial state, and wherein when the joining surfaces of the pair of resin members are abutted against each other, the recesses form a hole substantially corresponding to an outer shape of a part of the flat shielded cable;

interposing the grounding wire between the flat shielded cable and the resin member; and applying ultrasonic vibration across the pair of resin members so that at least the insulating outer jacket is melted and scattered, and a conductor of the ground wire and the grounding wire-use contact portion are electrically brought into contact with each other.

wherein the respective joining surface of the pair of resin members, portions where both the grounding wire-use contact portion and the ground wire are supposed are formed as flat surfaces for pressing the ground wire-use contact portion and the grounding wire with the respective joining surfaces abutting against each other.

13. The method according to claim 12, wherein in the clamping step, the pair of resin members compress the flat shielded cable.

14. The method according to claim 12, wherein when the pair of resin members clamp the flat shielded cable, the pair of resin members do not contact a of the flat shielded cable located on an outer side of each of the shielded cores; and wherein the pair of resin members contact a portion of the flat shielded cable located on an outer side of the grounding wire-use contact portion.

* * * * *